US007600768B2

(12) United States Patent
Chen et al.

(10) Patent No.: US 7,600,768 B2
(45) Date of Patent: Oct. 13, 2009

(54) ONE PIECE FLEXIBLE SKATEBOARD

(75) Inventors: Robert Chen, San Marino, CA (US); Robert A. Hadley, Yorba Linda, CA (US)

(73) Assignee: Razor USA, LLC, Cerritos, CA (US)

( * ) Notice: Subject to any disclaimer, the term of this patent is extended or adjusted under 35 U.S.C. 154(b) by 209 days.

(21) Appl. No.: 11/850,413

(22) Filed: Sep. 5, 2007

(65) Prior Publication Data

US 2009/0058028 A1 Mar. 5, 2009

(51) Int. Cl.
*A63C 17/01* (2006.01)

(52) U.S. Cl. ..... 280/87.042; 280/87.05

(58) Field of Classification Search ..... 280/87.01, 280/87.021, 87.03, 87.041, 87.042, 87.05, 280/11.27, 11.25, 267, 268
See application file for complete search history.

(56) References Cited

U.S. PATENT DOCUMENTS

| | | | | |
|---|---|---|---|---|
| 2,051,762 | A | 8/1936 | Vincent | |
| 3,399,906 | A | 9/1968 | Portnoff | |
| 3,982,766 | A | 9/1976 | Budge | |
| 4,060,253 | A | 11/1977 | Oldendorf | |
| 4,076,267 | A * | 2/1978 | Lipscomb | 280/87.042 |
| 4,082,306 | A * | 4/1978 | Sheldon | 280/87.042 |
| 4,092,033 | A | 5/1978 | Swain | |
| 4,093,252 | A | 6/1978 | Rue | |
| 4,140,326 | A | 2/1979 | Huber | |
| 4,245,848 | A | 1/1981 | Dudouyt | |
| 4,295,656 | A | 10/1981 | Moore | |
| 4,411,442 | A | 10/1983 | Rills | |
| 4,458,907 | A * | 7/1984 | Meredith | 280/87.042 |
| 4,915,403 | A | 4/1990 | Wild et al. | |
| 4,921,513 | A | 5/1990 | Parten | |
| 4,930,794 | A | 6/1990 | Chan | |
| 4,955,626 | A | 9/1990 | Smith et al. | |
| 5,098,087 | A | 3/1992 | Matile et al. | |
| 5,160,155 | A | 11/1992 | Barachet | |
| 5,419,570 | A | 5/1995 | Bollotté | |

(Continued)

FOREIGN PATENT DOCUMENTS

| | | |
|---|---|---|
| GB | 2318519 | 10/1996 |

(Continued)

OTHER PUBLICATIONS http://skateboard.about.com/cs/fringeboarding/gr/XBoard.html, "About: Skateboarding; The Wave".

(Continued)

*Primary Examiner*—Christopher P Ellis
*Assistant Examiner*—Brian Swenson
(74) *Attorney, Agent, or Firm*—Irell & Manella LLP

(57) ABSTRACT

A telescopic skateboard may include a pair of direction casters mounted for steering rotation on a twistable one piece skateboard. A center section may be made sufficiently narrower than outboard foot support areas so that the board may be twisted by a rider to add energy for rolling motion to wheels in the casters. The center section may also be made sufficiently resistant to bowing and twist so that the skateboard may be ridden as a conventional, non-flexible skateboard. The center section may include telescoping male and female portions and an extension control.

15 Claims, 23 Drawing Sheets

U.S. PATENT DOCUMENTS

| | | | |
|---|---|---|---|
| 5,505,474 | A | 4/1996 | Yeh |
| 5,540,455 | A | 7/1996 | Chambers |
| 5,549,331 | A | 8/1996 | Yun et al. |
| 5,566,956 | A | 10/1996 | Wang |
| 5,601,299 | A | 2/1997 | Yun et al. |
| 5,622,759 | A | 4/1997 | Fuster |
| 5,707,068 | A | 1/1998 | Bradfield |
| 5,826,895 | A | 10/1998 | Bradfield |
| 5,853,182 | A | 12/1998 | Finkle |
| 5,855,385 | A | 1/1999 | Hambsch |
| 5,984,328 | A | 11/1999 | Tipton |
| 6,059,303 | A | 5/2000 | Bradfield |
| 6,102,415 | A | 8/2000 | Stweardson |
| 6,193,249 | B1 | 2/2001 | Buscaglia |
| 6,254,113 | B1 | 7/2001 | Doman |
| 6,293,565 | B1 | 9/2001 | Bouchard et al. |
| 6,315,304 | B1 | 11/2001 | Kirkland et al. |
| 6,338,494 | B1 | 1/2002 | Killian |
| 6,398,237 | B1 | 6/2002 | Attey |
| 6,419,248 | B1 | 7/2002 | Kay |
| 6,419,249 | B1 | 7/2002 | Chen |
| 6,428,022 | B1 | 8/2002 | Namiki |
| 6,494,467 | B1 | 12/2002 | Menges |
| 6,502,850 | B1 | 1/2003 | Schaller et al. |
| 6,669,215 | B2 | 12/2003 | Laporte |
| 6,910,698 | B2 | 6/2005 | Turner et al. |
| 6,979,006 | B2 | 12/2005 | Pierron |
| 7,044,486 | B2 | 5/2006 | Wright et al. |
| 7,083,178 | B2 | 8/2006 | Potter |
| 7,195,259 | B2 | 3/2007 | Gang |
| 7,325,819 | B2 * | 2/2008 | Kwak ..... 280/87.042 |
| 7,367,572 | B2 * | 5/2008 | Jiang ..... 280/87.042 |
| 2002/0043774 | A1 | 4/2002 | Chou |
| 2002/0149166 | A1 | 10/2002 | Potter |
| 2003/0155733 | A1 | 8/2003 | Tan et al. |
| 2004/0262872 | A1 | 12/2004 | Kang |
| 2006/0055137 | A1 | 3/2006 | Jiang |
| 2006/0163830 | A1 | 7/2006 | Kwak |
| 2007/0001414 | A1 | 1/2007 | Kang |

FOREIGN PATENT DOCUMENTS

| | | |
|---|---|---|
| JP | H01-117385 U | 8/1989 |
| JP | 2001029663 | 2/2001 |
| KR | 1020050060368 | 6/2005 |
| KR | 200410530 | 3/2006 |
| SU | 1405865 | 4/1986 |
| WO | 9301870 | 2/1993 |
| WO | 0240116 | 5/2002 |
| WO | WO 2004/105901 A1 | 12/2004 |

OTHER PUBLICATIONS http://www.streetsurfing.com/wave/skating.html, "The Wave", Streetsurfing.
http://skateboard.about.com/cs/fringeboarding/gr/?once=true&, "About: Skateboarding; Other Boardsports".

* cited by examiner

ONE PIECE FLEXIBLE SKATEBOARD

RELATED APPLICATIONS

This application is related to U.S. patent application Ser. No. 11/687,594, filed Mar. 16, 2007; which is a continuation in part of U.S. patent application Ser. No. 11/462,027, filed Aug. 2, 2006; which claims the priority of the filing date of U.S. Provisional application Ser. No. 60/795,735, filed Apr. 28, 2006.

BACKGROUND OF THE INVENTION

1. Field of the Invention

This invention is related to skateboards and particularly to skateboards in which one end of the skateboard may be twisted or rotated, with respect to the other end, by the user.

2. Description of the Prior Art

Various skateboard designs have been available for many years. Conventional designs typically require the user to lift one foot from the skateboard to push off on the ground in order to provide propulsion. Such conventional skateboards may be steered by tilting the skateboard to one side and may be considered to be non-flexible skateboards. Skateboards have been developed in which a front platform and a rear platform are spaced apart and interconnected with a torsion bar or other element which permits the front or rear platform to be twisted or rotated with respect to the other platform. Other skateboard designs are known which include telescoping structures which provide flexure. Such platforms have limitations, including complexity, limited control or configurability of flexure and cost.

What is needed is a new skateboard design without such limitations.

SUMMARY OF THE DISCLOSURE

A flexible skateboard is disclosed having a one piece platform formed of a material twistable along a twist axis, the material formed to include a pair of foot support areas along the twist axis, generally at each end of the platform, to support a user's feet and a central section between the foot support areas and a pair of caster assemblies, each having a single caster wheel mounted for rolling rotation, each caster assembly mounted at a user foot support area for steering rotation about one of a pair of generally parallel pivot axes each forming a first acute angle with the twist axis. The central section of the platform material may be configured to be sufficiently narrower than the foot support areas to permit the user to add energy to the rolling rotation of the caster wheels by twisting the platform alternately in a first direction and then in a second direction while the foot support areas.

The central section in the material may be sufficiently resistant to twisting about the twist axis in response to forces applied by the user to provide feedback to the user before steering the caster assemblies in opposite directions about their related pivot axes. The central section may include vertical support providing sufficiently resistance to bending along the twist axis to support a user on the foot support areas for comfortably riding the platform without substantial bending along the twist axis, such as a sidewall running along each edge of the central section running along the twist axis which may have a height decreasing towards the ends of the central section. An insert may be mountable between the sidewalls to increase the resistance to twisting of the central section.

The foot support areas are sufficiently more resistant to twisting about the twist axis than the central section to reduce stress caused by twisting of the user's feet. A wedge mounted between each of the pair of caster assemblies and the platform to support the related caster assembly for steering rotation about the related pivot axis and/or a hollow wedge may be formed in the platform for mounting each related caster assembly for steering rotation about the related pivot axis. A threaded road may be used to secure the caster assembly to the platform with a nut mounted within the related hollow wedge.

Tension or torsion springs may be mounted to each caster assembly for centering the wheel therein along the twist axis. The torsion springs may be mounted around the pivot axis and/or within the related wheel assembly. The platform may be configured to operate as a non-flexible skateboard within a first range of forces applied by the user to twist the board and/or configured to operate as a flexible skateboard for forces greater than the first range. A one piece flexible skateboard body is disclosed having a one piece flexible platform having a narrow section twistable about a long axis and mountings for each of a pair of steerable casters. The narrow section may be sufficiently twistable about the long axis by a rider to cause the board to move forward from a standing start on the steerable casters when mounted and/or sufficiently rigid to prevent bowing when supporting a rider on the steerable casters. The narrow section may be sufficiently rigid so that the platform may be operated as either a non-flexible or flexible skateboard when the steerable casters are mounted. The remainder of the platform may be more resistant to flexing than the narrow section and hollow wedges may be molded into the flexible platform. A mounting point for a spring configured to center the steerable casters along the long axis may be provided.

In another aspect, a flexible skateboard may include a one piece flexible skateboard platform having a foot support area at each end of a long axis and a narrow central section between the foot support areas, a single wheel mounted for rotation under each foot support area and for pivoting about one of a pair of generally parallel axes forming an acute angle with the flexible skateboard platform. The one piece skateboard platform may be sufficient resistant to twisting along the central axis to permit a rider to comfortably steer the skateboard by tilting the skateboard platform without substantially rotating the foot support areas relative to each other while being sufficiently flexible to be twisted across the narrow central section in alternating directions about the long axis by the rider to provide locomotion of the skateboard by the rider, e.g. from a standing start, by rotating the foot support areas relative to each other.

The one piece skateboard platform may be sufficiently flexible to be twisted in alternating directions about the long axis by the rider to provide locomotion from a standing start and may be sufficiently resistant to bowing in the central area to support the rider without substantial bowing along the long axis when the rider at least partially supports one foot on the central section. The one piece flexible skateboard platform may include a pair of downward facing walls, such as sidewalls or ribs extending below the skateboard platform, at least along the central section to resist resisting bowing along the long axis. The skateboard may also have an axial insert positioned between the downward facing sidewalls to resist twisting of the one piece flexible platform along the long axis. The foot support areas may include at least one well area along a portion of an edge of the foot support area generally along the long axis and may have a foot support insert mounted in at least one of the well areas. Each foot support insert may have an upper gripping surface, generally level with an upper surface of the platform, for gripping contact with one of the rider's feet which may include upwardly facing projections for improving the gripping surface grip. The platform may be made of wood. Each well area may have a downward facing sidewall along an inner edge thereof and an upward facing sidewall along an outer edge thereof, the sidewalls resisting bowing along the well area.

A transition area may be provided where the upward and downward facing sidewalls of one end of each well area are joined together with the one end of one of the downward facing sidewalls along the central area to resist bowing of the one piece flexible platform along the long axis. The transition area may make the foot support areas are less flexible along the long axis than the central section. The one piece flexible skateboard platform may have a molded plastic platform including hollow wedges molded into the foot support areas for mounting the wheels at the common acute angle. A pair of inserts may be provided to resist twisting along the long axis, each insert mounted in an opening through the one piece flexible skateboard platform along the long axis in the central section, the pair of inserts separated by a bulkhead structure in the platform transverse to the long axis.

In another aspect, a one piece skateboard platform may include an elongate flexible platform having a long axis including a foot support area at each end of the platform having a foot support area width sufficient to support a rider's foot transverse to the long axis and an integral central area connecting the foot support areas, the central area having a central area width sufficiently narrower than the foot support area width to permit sufficient relative twisting of foot support areas along the long axis by the rider to provide substantial forward locomotion of a skateboard formed by supporting each foot support area with a single wheel mounted thereto for rotation and pivoted about generally parallel axes forming an acute angle with the long axis. At least one wall support extending below the central area to each foot support area may be provided to resist bowing of the central section along the long axis when at least a portion of the rider's foot is supported on the central section.

A hollow wedge may be molded into each foot support area to support a wheel assembly for pivoting along one of the generally parallel axes. At least one wall support may be integral with the elongate flexible platform and may include a downward facing sidewall rib extending substantially around an outer edge of the foot support and central areas. A cavity may be provided for mounting an axial insert to resist twisting of the platform and a plurality of well areas may be molded into the foot support areas for increasing rigidity of the foot support areas and supporting grips for the rider's feet.

In another aspect, a telescopic flexible skateboard may include a front section including an integral board portion with a foot support area and supporting a first offset caster wheel assembly pivotable about a first axis at a first angle to the vertical, a rear section including an integral board with a foot support area and supporting a second offset caster wheel assembly pivotable about a second axis, telescopic male and female portions, each connected to one of the front or rear sections, slidably engaged to form a telescopic skateboard having a long axis with a narrowed central section and an extension control operable by a skateboard rider to lock the slidably engaged male and female portions, wherein the front and rear sections, including the male and female portions, are sufficiently flexible so that a user can provide locomotion to the skateboard by applying differential pressure to the front and rear sections.

The telescopic skateboard may be sufficiently resistant to twisting along the central axis to permit a rider to comfortably steer the skateboard by tilting the skateboard platform without substantially rotating the front and rear sections relative to each other while being sufficiently flexible to be twisted across the narrowed central section in alternating directions about the long axis by the rider to provide locomotion of the skateboard by the rider by rotating the front and rear sections relative to each other. The telescopic skateboard may be sufficiently flexible to be twisted in alternating directions about the long axis by the rider to provide locomotion from a standing start. The telescopic skateboard platform may be sufficiently resistant to bowing in the narrowed central section area to support the rider without substantial bowing along the long axis when the rider at least partially supports one foot on the narrowed central section.

The telescopic male and female portions each may have a pair of mating downward facing walls at least extending below the narrowed central section to resist resisting bowing along the long axis. The telescopic male and female portions each may have a molded plastic riding board including hollow wedges molded therein for mounting the wheels at the common acute angle. The telescopic male and female portions each may have a molded plastic riding board including one of the telescopic male and female portions molded together with the molded plastic board. The telescopic male and female portions each may have a molded plastic riding board including one of the telescopic male and female portions molded together with the molded plastic board.

The telescopic male and female portions each may have a molded portion having a pair of substantially vertical walls. A vertical dimension of the substantially vertical walls may be on the order of a vertical thickness of the riding board. The telescopic male and female portions each may have a relatively flat top side in a plane parallel with the riding board. The telescopic male portion each may a four sided, partially circular or elliptical cross section which may have one or more keys to reduce relative twist between the male and female portions.

DETAILED DISCLOSURE OF THE PREFERRED EMBODIMENT(S)

Figure 1:
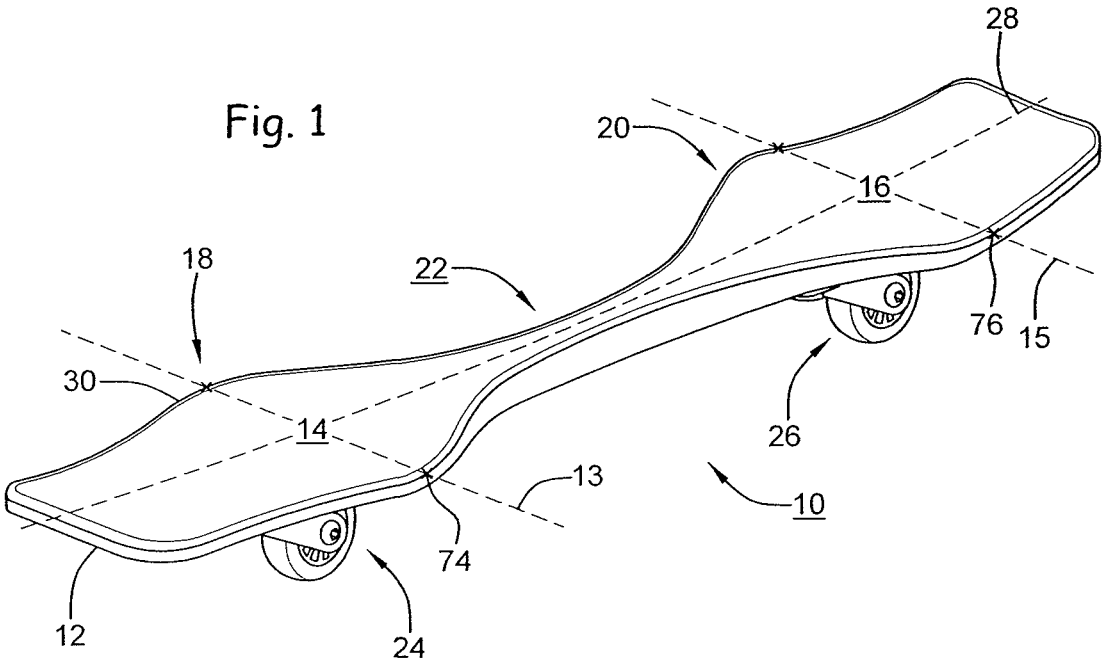
FIG. 1 is an isometric view of the top of one piece flexible skateboard 10.

Referring now to FIG. 1, flexible skateboard 10 is preferably fabricated from a one piece, molded plastic platform 12 which includes foot support areas 14 and 16 for supporting the user's feet about a pair of directional caster assemblies mounted for pivoting or steering rotation about generally parallel, trailing axes. Each caster assembly includes a single caster wheel mounted for rolling rotation about an axles positioned generally below the foot support areas. Skateboard 10 generally includes relatively wider front and rear areas 18 and 20, each including one of the foot support areas 14 and 16, and a relatively narrower central area 22. The ratio of the widths of wider areas 18 and 20 to narrow central area 22 may preferably be on the order of about 6 to 1. Wheel assemblies 24 and 26 are mounted below one piece platform 12 generally below foot support areas 14 and 16.

In operation, the skateboard rider or user places his feet generally on foot support areas 14 and 16 of one piece platform 12 and can ride or operate skateboard 10 in a conventional manner, that is as a conventional non-flexible skateboard, by lifting one foot from board 10 and pushing off against the ground. The user may rotate his body, shift his weight and/or foot positions to control the motion of the skateboard. For example, board 10 may be operated as a conventional, non-flexible skateboard and cause steering by tilting one side of the board toward the ground. In addition, in a preferred embodiment, board 10 may also be operated as a flexible skateboard in that the user may cause, maintain or increase locomotion of skateboard 10 by causing front and rear areas 18 and 20 to be twisted or rotated relative to each other generally about upper platform long or twist axis 28.

It is believed by applicants that the relative rotation of different portions of platform 12 about axis 28 changes the angle at which the weight of the rider is applied to each of the wheel assemblies 24 and 26 and therefore causes these wheel assemblies to tend to steer about their pivot axes. This tendency to steer may be used by the rider to add energy to the rolling motion of each caster wheel about its rolling axle and/or to steer.

As a simple example, if the user or rider maintained the position of his rearward foot (relative to the intended direction of motion of board 10) on foot support area 16, generally along axis 15 and parallel to the ground, while maintaining his front foot in contact with support area 14, generally along axis 13 while lowering, for example, the ball of his front foot and/or lifting the heal of that foot, front section 18 of board 10 would tend to twist clockwise relative to rear section 20 when viewed from the rear of board 10. This twist would result in the tilting right front side 30 of board 10 in one direction, causing the weight of the rider to be applied to wheel assembly 24 at an acute angle relative to the ground rather than to be applied orthogonal to the ground, and would therefore cause wheel assemblies 24 and 26 to begin to roll, maintain a previous rolling motion and/or increase the speed of motion of the board 10 e.g. by adding energy to the rolling motion of the wheels.

In practice, the rider can cause the desired twist of platform 12 of board 10 in several ways which may be used in combination, for example, by twisting or rotating his body, applying pressure with the toe of one foot while applying pressure with the heel of the other foot, by changing foot positions and/or by otherwise shifting his weight. To provide substantial locomotion, the rider can first cause a twist along axis 28 in a first direction and then reverse his operation and cause the platform to rotate back through a neutral position and then into a twist position in the opposite direction. Further, while moving forward, the rider can use the same types to motion, but at differing degrees, to control the twisting to steer the motion of board 10. The ride can, of course, apply forces equally with both feet to operate board 10 without substantial flexure.

Wider sections 18 and 20 have an inherently greater resistance to twisting about axis 28 than narrower section 22 because of the increased stiffness due to the greater surface area of the portions to be twisted. That is, narrower section 22 is narrower than wider sections 18 and 20. The resistance of the various sections of platform 12 to twisting can also be controlled in part by the choice of the materials, such as plastic, used to form platform 12, the widths and thicknesses of the various sections, the curvature if any of platform 12 along axis 28 or along any other axes and/or the structure and/or cross section shape of the various sections.

Figure 2:
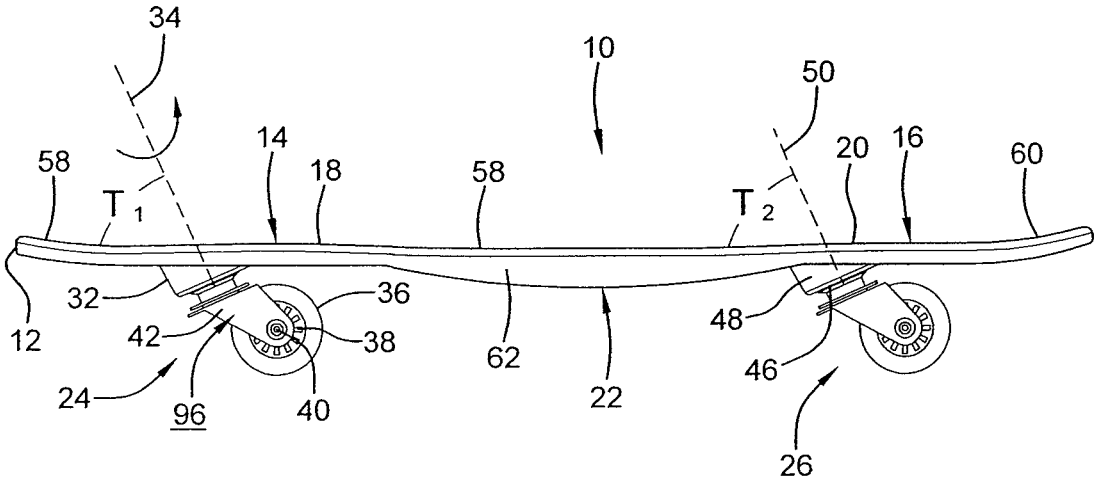
FIG. 2 is a side view of skate board 10.

Referring now to FIG. 2, skateboard 10 may include sidewalls 62 and/or other structures. Sidewalls 62 may be increased in height, e.g. orthogonal to the top surface 58 of platform 12, in the central portion of central area 22 to provide better vertical support if required. In a preferred embodiment, the height of sidewall 62 in central area 22 varies from relatively tall in the center of board 10 to relatively shorter beginning where areas 18 and 20 meet central area 22. The ratio of the sidewall height "H" in central section 22, to the side wall heights in wider areas 18 and 20 may preferably be on the order of about 2 to 1.

As shown in FIG. 2, wheel assemblies 24 and 26 may be substantially similar. Wheel assembly 24 may be mounted to an inclined or wedge shape wheel assembly section 32 by the insertion of pivot axle 41 (visible in FIG. 4) a suitable opening in wedge 32 for rotation about axis 34. The rotation of wheel assembly 24 about axis 34 may preferably be limited, for example, within a range of about ±180°, and more preferably within a range of about ±160°, of tilt with respect to an upright position orthogonal to the plane of platform 12 to improve the handling and control of board 10. Each direction caster may include a tension, compression or torsional spring to provide self-centering, that is, to maintain the alignment of wheels 36 along axis 28 (visible in FIG. 1) as shown and described for example with reference to FIG. 13 below.

A pair of wedges 32 and 48 may be formed in platform 12 and include a hole for wheel assembly axle 41 mounted along axis 34. Alternately, wedges 32 and 48 may be formed as separate pieces from platform 12 and be connected thereto during manufacture of board 10 by for example screws, clips or a snap in arrangement in which the upper surfaces of wedges 32 and 48 are captured by an appropriate receiving section molded into the lower face of platform 12. Wedge 32 may be used to incline axis 34, about which each caster may pivot or turn, with respect to the upper surface 58 of platform 12 at an acute angle θ1 which may preferably be an angle of about 24°.

Wheel assembly 24 may include wheel 36 mounted on hub 38 which is mounted to axle 40 for rotation, preferably in bearings. Axle 40 is mounted in fork 96 of caster frame 42. A bearing or bearing surface may preferably be inserted between caster frame 42 and wedge 32, or formed on caster frame 42 and/or wedge 32 and is shown as bearing 46 in wheel assembly 26 mounted transverse to axis 50 in wedge 48 in rearmost wider section 20. Wheel assemblies 24 and 26 are mounted along axes 34 and 50 each of which form an acute angle, θ1 and θ2 respectively, with the upper surface of platform 12. In a preferred embodiment, θ1 and θ2 may be substantially equal. The use of identical wheel assemblies for front and rear reduces manufacturing and related costs for board 10. The center of foot support 14 may conveniently be positioned directly above axis 40 in wheel assembly 24 and center of foot support 16 may be positioned similarly above the axis of rotation of the wheel in wheel assembly 26.

During operation, users may shift their feet from foot positions 14 and 16 toward central area 22 which as described above is a narrower and therefore more easily twisted portion of platform 12. In order to provide addition vertical strength to support the weight of one of the user's feet, taller sidewalls 62 may be used in central section 22 as shown. In a preferred embodiment, the height of sidewalls 62 may generally rise in a gently curved shape from wider support areas 18 and 20 to a maximum generally in the center of central section 22.

Platform 12 of board 10 is in a generally horizontal rest or neutral position, e.g. in neutral plane 17, when no twisting force is applied to platform 12 of board 10. This occurs, for example, when the rider is not standing on board 10 or is standing in a neutral position. When board 10 is in the neutral position, axes 34 and 50, angles θ1 and θ2 and board axis 28 (shown in FIG. 1) are all generally in the same plane orthogonal to neutral plane 17 of the top of platform 12, while axes 13 and 15 are in neutral plane 17. Upper surface 58 may not be flat and in a preferred embodiment, toe or leading end 60 and heel or trailing end 62 of surface 58 may have a slight upward bend or kick as shown. In a preferred embodiment, central section 22 flares out at each end to wider sections 18 and 20 while wider front section 18 may be slightly longer than rear section 20. When a twisting force is applied to board 10, one or more of axes 34 and 50 move out of the vertical plane as described below in greater detail with respect to FIG. 5.

Figure 3:
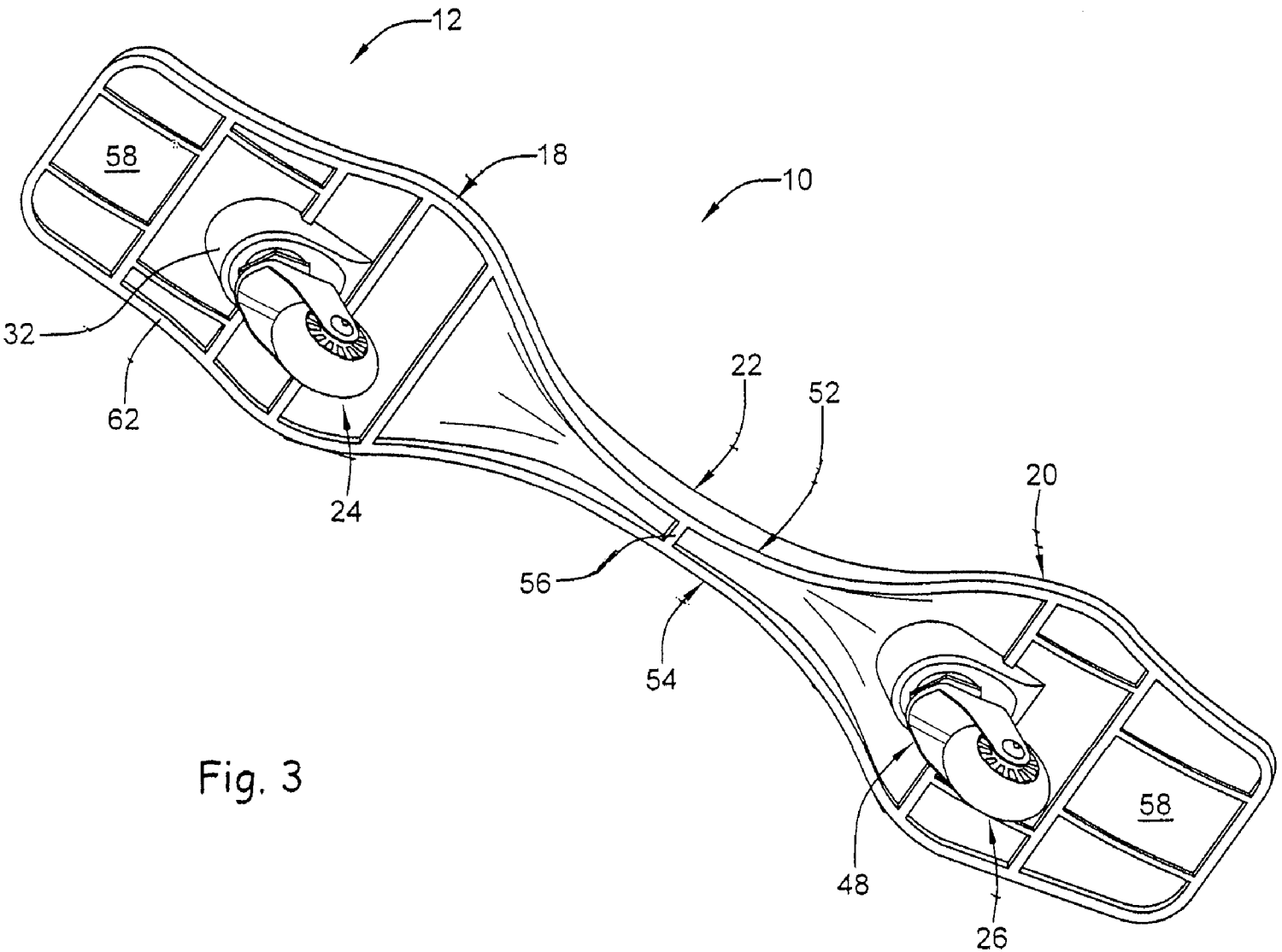
FIG. 3 is an isometric view of the bottom of one piece flexible skateboard 10.

Referring now to FIG. 3, an isometric view of the bottom of skate board 10 is shown including platform 12, wider sections 18 and 20 and narrower or midsection 22. Wheel assemblies 24 and 26 are mounted to inclined wedges 32 and 48 which are shown as molded-in portions of platform 12. Platform 12 may include a generally flat upper surface 58, (also shown in FIG. 2) as well as a wall portion 62 formed generally at a right angle to layer 58. Peripheral sidewall 62 may have a constant cross sectional width, "w", but in a preferred embodiment the height "H" of wall 62 (also shown in FIG. 2) may vary for example to increase generally in midsection 22 in order to provide additional vertical support for the user when and if the user place some of his weight on midsection 22. The sections of sidewall 62 with increased height in midsection 22 are shown as starboard wall section 54 and port wall section 52. Wall sections 52 and 54 may also have transverse wall members, such as full or partial cross brace or rib 56, which serve to both provide additional vertical support if needed and to increase the resistance to twisting of various portions of board 10 about axis 28.

Figure 4:
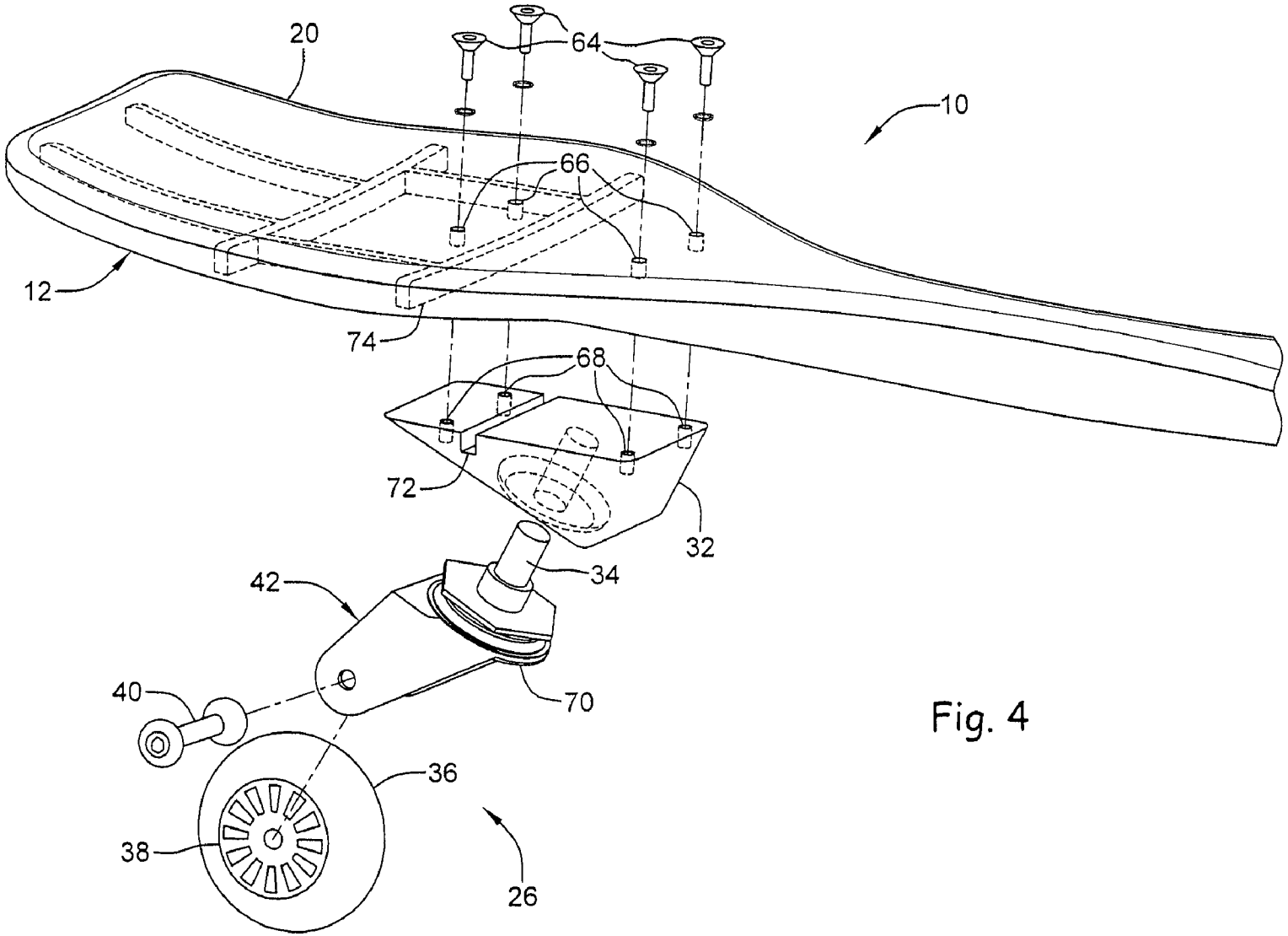
FIG. 4 is an isometric view of a portion of the bottom of board illustrating a removably mounted wedge 32.

Referring now to FIG. 4, an exploded isometric view of rear section 20 of an alternate embodiment of board 10 is shown in which each inclined wedge 32 is formed as a separate piece from platform 12 and mounted thereto by any convenient means such as screws 64 which may be inserted through holes 66 in appropriate locations in platform 12 to mate with holes 68 in inclined wedge 32. Screws 64 may be self threading or otherwise secured to wedge 32. Frame 42 of wheel assembly 26 includes caster top 70, bearing cap 95 and pivot axle 41, a top portion of which is received by and mounted in a suitable opening in wedge 32 for rotation about axis 34. Axle 40 is mounted in fork 96 of frame 42. Wheel 36 is mounted on hub 38 which is mounted for rotation about axle 40.

Wedge 32 may also be further secured to platform 12 by the action of slot 72 which captures a feature of the bottom surface of platform 12 such as transverse rib 74. As shown, wedge 32 may be conveniently mounted to and dismounted from platform 12 permitting replacement of wedge 32 by other wedges with potentially different configurations including different angles of alignment for axis 34 and/or other characteristics.

Figure 5:
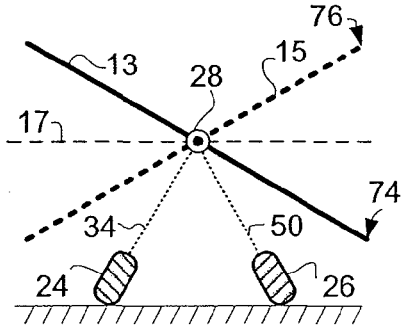
FIG. 5 is a graphical illustration of a skateboard twisting in a first direction.

Referring now to FIG. 5, a graphical depiction of the motions of portions of platform 12 are shown. Neutral plane 17 is shown in the horizontal position indicating top surface 58 of platform 12 when no twisting forces are applied to skate board 10. Axis 28, along the centerline of top surface 58 of platform 12, is shown orthogonal to the drawing, coplanar with and centered in neutral plane 17. Axis 13 is shown as a solid line and represents the location of a cross section of the top surface of platform 12 at front foot position 14 in wide forward section 18 when the port side of wide section 18 is depressed below the horizontal or neutral plane 17 for example by the user pressing down on the port side and/or lifting up of the starboard side of foot position 14. Axis 15 is shown as a dotted line, to distinguish it from axis 13 for convenience, and represents the location of a cross section of the top surface of platform 12 at rear foot position 16 in wide aft section 20 of platform 12 when the starboard side of wide section 20 is depressed below the horizontal or neutral plane 17 for example by the user pressing down on the starboard side and/or lifting up of the port side of rear foot position 16. Thus FIG. 5 represents the relative angles of wider front and rear sections 18 and 20 of platform 12 when the user has completed a maneuver in which he has twisted wider front and rear sections 18 and 20 in opposite directions to a maximum rotation.

Wheel assembly 24 is shown mounted for rotation about axis 34. Axis 34 of front wheel assembly 24 remains orthogonal to axis 13 of foot position 14. Similarly, wheel assembly 26 is shown mounted along axis 50. Axis 50 of rear wheel assembly 26 remains orthogonal to axis 15 of foot position 16. For ease of illustration, wheel assemblies 24 and 26 are depicted in cross section without rotation of the wheel assemblies about axes 34 and 50.

In the position shown in FIG. 5, wheel assemblies 24 and 26 have presumably been rotated from vertical positions to the opposite outward positions by action of the user in twisting board 10. It must be noted that front and rear wheel assemblies 24 and 26 are able to rotate or pivot about their respective axes 34 and 50. During the twisting of board 10, wheel assemblies 24 and 26 rotate about the central axes of the wheels as long as such rotation takes less force than would be required to skid the wheel assemblies into the positions as shown. The direction of this rotation is not random, but rather controlled by angles θ1 and θ2 between axes 34 and 50 and platform 12.

The view shown in FIG. 5 is looking at the front of board 10 so that axes 34 and 50 are at right angles to one of the portions of platform 12. A side view of the board 10, as shown for example in FIG. 2, illustrates that each wheel assembly is mounted for pivotal rotation about an axis at an acute trailing angle to platform 12. The rotation of the wheels about each wheel axis of the wheel assemblies, combined with a slight rotation of each wheel assembly about its axis 34 or 50 when the ends of board 10 are twisted in opposite directions, causes, maintains or increases forward motion or locomotion of board 10 because axes 34 and 50 are inclined so that each wheel assembly is in a trailing configuration, aft of the point at which each axis penetrates board 12 from below. That is, axes 34 and 50 about which each wheel assembly turns are both inclined in the same direction, preferably at a trailing angle with respect to the direction of travel and are preferably parallel or nearly so.

Figure 6:
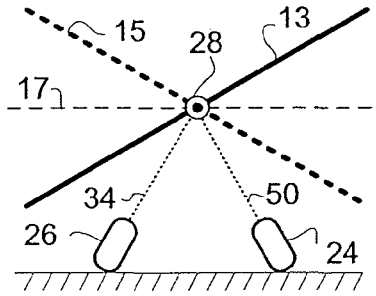
FIG. 6 is a graphical illustration of a skateboard twisting in a second direction.

Referring now to FIG. 6, axes 13 and 15 are shown in the opposite positions than shown in FIG. 5, which would result from the user reversing his foot rotation, i.e. by twisting the front and rear sections of board 10 by pushing down and/or lifting up opposite of the way done to cause the twisting shown in FIG. 5. However, the combination of the rotation of the wheels and the rotation of the wheel assemblies adds to the forward locomotion because axes 34 and 50 are in a trailing position relative to the forward motion of board 10.

Figure 7:
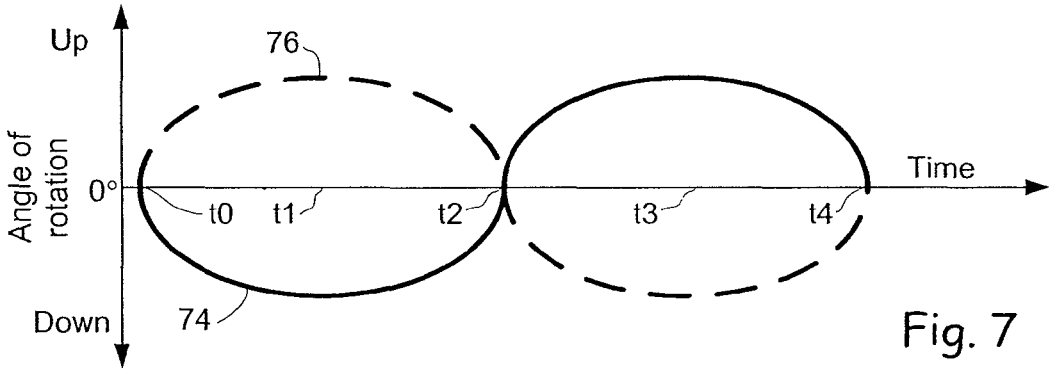
FIG. 7 is a graphical illustration of the twisting of board 10 having a first configuration.

Referring now to FIG. 7, the solid line is a graphical representation of the twisting rotation as a function of time of point 74 (shown in FIGS. 1 and 5) at a forward port side edge of wide section 18 during the twisting motions occurring to board 10 as depicted in FIGS. 5 and 6. Point 74 may be considered to be the point at which axis 13 intersects the port side edge of platform 12. At some instant of time, such as t0, point 74 is at zero rotation. As the port side of forward wide section 18 is rotated downward by force applied by the user, point 74 rotates downward until the maximum force is applied by the user and point 74 reaches a maximum downward rotation at some particular time such as time t1. Thereafter, as the downward force applied by the user to the portside of forward section 18 decreases, the downward angle of rotation of point 74 decreases until at some time t2, point 74 returns to a neutral rotational position at a rotational angle of 0.

Thereafter, downward pressure can be applied by the user to the starboard edge of section 18, e.g. in foot position 14, to cause point 74 on the port side to twist or rotate upwards, reaching a maximum force and therefore maximum rotation at time t3 after which the force may be continuously reduced until neutral or zero rotation is reached at time t4. Similarly, as shown by the solid line in FIG. 7, the user can apply forces in the opposite direction to rearward wide section 20 so that point 76, at the rearward port side of foot position 16, rotates from the neutral position at time t0, to a maximum upward rotation at time t1, through neutral at time t2, to a maximum downward rotation at time t3 and back to neutral at time t4.

Figure 8:
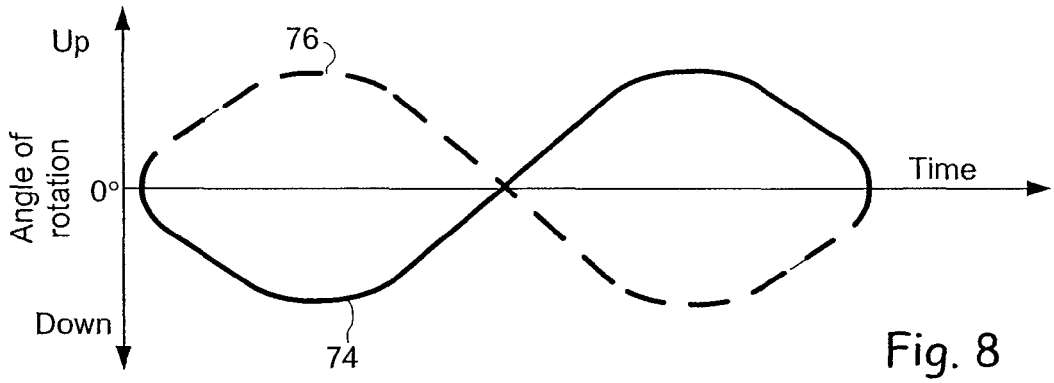
FIG. 8 is a graphical representation of the twisting of board 10 having a second configuration to provide a different flexing function in response to applied twisting forces.

Referring now to FIG. 8, the amount of force that must be applied by the user to cause a particular degree of twist may correlate to the amount of control the user has with board 10. It may be desirable for the relationship between force and rotation to be varied as a function of rotation or force. For example, in order to achieve a "stiff" board while permitting a large range of total twist without requiring undo force, the shape of platform 12 may be configured so that the amount of force required to twist the board from the neutral plane seems relatively high to the user (at least high enough to be felt as feedback) even if the additional force required to continue rotating each section of the board past a certain degree of rotation seems relatively easier to the user. Further, as an added safety and control measure, the additional force required to achieve maximum rotation may then appear to the user to increase greatly. As shown in FIG. 8, the shape of the graphs of the rotation of points 74 and 76, for the same forces applied as function of time used to create the graph in FIG. 7, may be different providing a different feel to the user.

Figure 9:
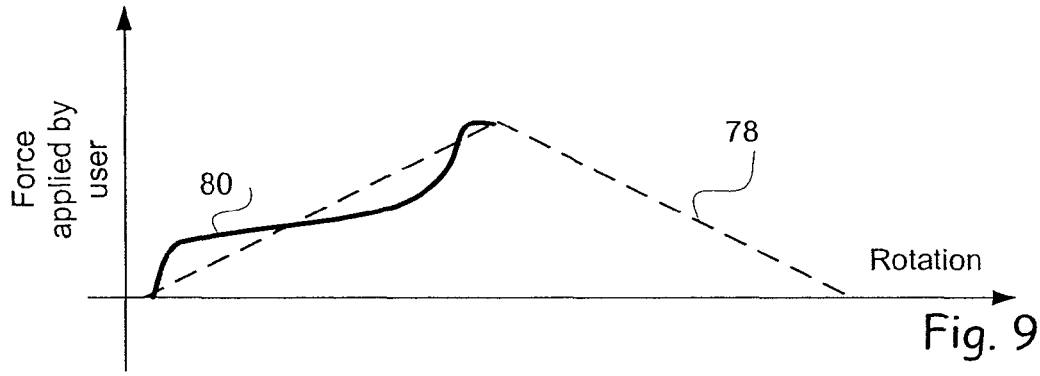
FIG. 9 is a graphic representation of the force applied to a one piece flexible skateboard as a function or twist or rotation of the board.

Referring now to FIG. 9, the concept just discussed above may be viewed in terms of a graph of force applied by the user as a function of desired rotation. The control feel desired for a skate board is not necessarily an easily described mathematical function of force to rotation. For some particular configuration of platform 12, with specific shapes and relationships between the front and rear wide areas and the central narrow area, and specific shapes and sizes of sidewalls, ribs, surface curves and other factors, there will be a particular way in which the board feels to the user to behave. That is, the feel of the board and especially the user's apparent control of the board, in preferred embodiments, is dependent on the shape and other board configuration parameters. For simplicity of this description, one particular board configuration may be said to have a "linear" feel, that is, the user's interaction with the board may seem to the user to result in a linear relationship between force applied and rotation or twist achieved. In practice, this feel is very subjective but none the less real although the actual mathematical relationship may not be linear. As a relative example, line 78 may represent a linear or other type of board having a first configuration of platform 12.

The shape and configuration of platform 12 may be adjusted, for example, by reducing the length of narrow section 22 along axis 28 (shown and described for example with reference to FIG. 1) and/or changing the taper of the transitions areas between narrow section 22 and front and rear wide sections 18 and 20. For a particular configuration of platform 12, lengthening the relative length of narrow section 22 may result in a perceived sloppiness of control by the user while shortening the relative length of narrow section 22 may result in a greater difficulty in achieving any rotation at all. A similar effect may be obtained by adjusting the width of central section 22 relative to wider sections 18 and 20. Line 80 represents a desired control relationship between force required and angle achieved by a particular configuration of platform 12. A more detailed example of twist as a function of force applied is shown below in FIGS. 14A and 14B and described for example with respect to FIGS. 14-19.

It is important to note that one advantage of the use of one piece platform 12 made of a plastic, twistable material formed in a molding process, is that the desired feel or control of the board can be achieved by reconfiguration of the mold for the one piece platform. Although it may be difficult to predict (with mathematical precision), the shape and configuration of platform 12 needed to achieve a desired feel, it is possible to iteratively change the shape and configuration of platform 12 by modifying the mold in order to develop a desirable configuration with an appropriate feel. In particular, the relationship between force applied and twist or rotation achieved by flexible skate board 10 is function of the relative widths, shapes and other configuration details of platform 12.

Platform 12 may be molded or otherwise fabricated from flexible PU-type elastomer materials, nylon or other rigid plastics and can be reinforced with fiber to further control flexibility and feel.

Figure 10:
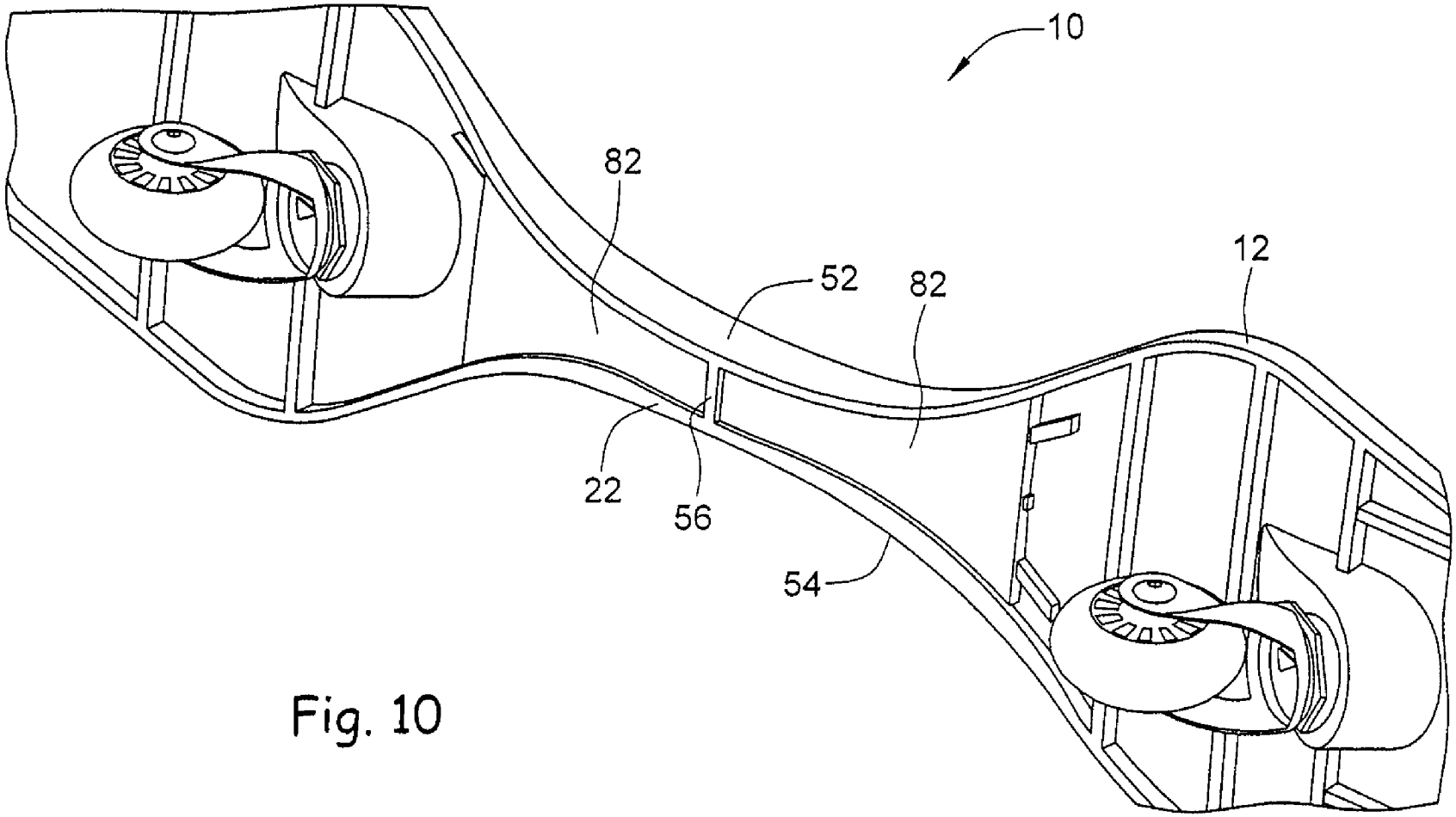
FIG. 10 is an isometric view of a portion of the underside of board 10 including removably installed elastomeric wedges 82 used to adjust the board flexing function.

Referring now to FIG. 10, an isometric view of a portion of the underside of one piece platform 12 is shown in which one or more wedges 82 are positioned within and between sidewalls 52 and 54 and transverse rib 56. Wedges 82 may preferably be made of an elastomeric material and serve to reduce the twisting flexibility narrow section 22 of platform 12 by, for example, resisting twisting motion of side walls 52 and 54. In a preferred embodiment, wedges 82 may be removably secured to the bottom side of one piece platform 12 by tightly fitting between the sidewalls or by use of screws or clips. The addition or removal of wedges 82 changes the flexure characteristics of platform 12 and therefore the feel or controllability of board 10. For example, wedges 82 may be added for use by a beginning user and later removed for greater control of board 10.

Figure 11:
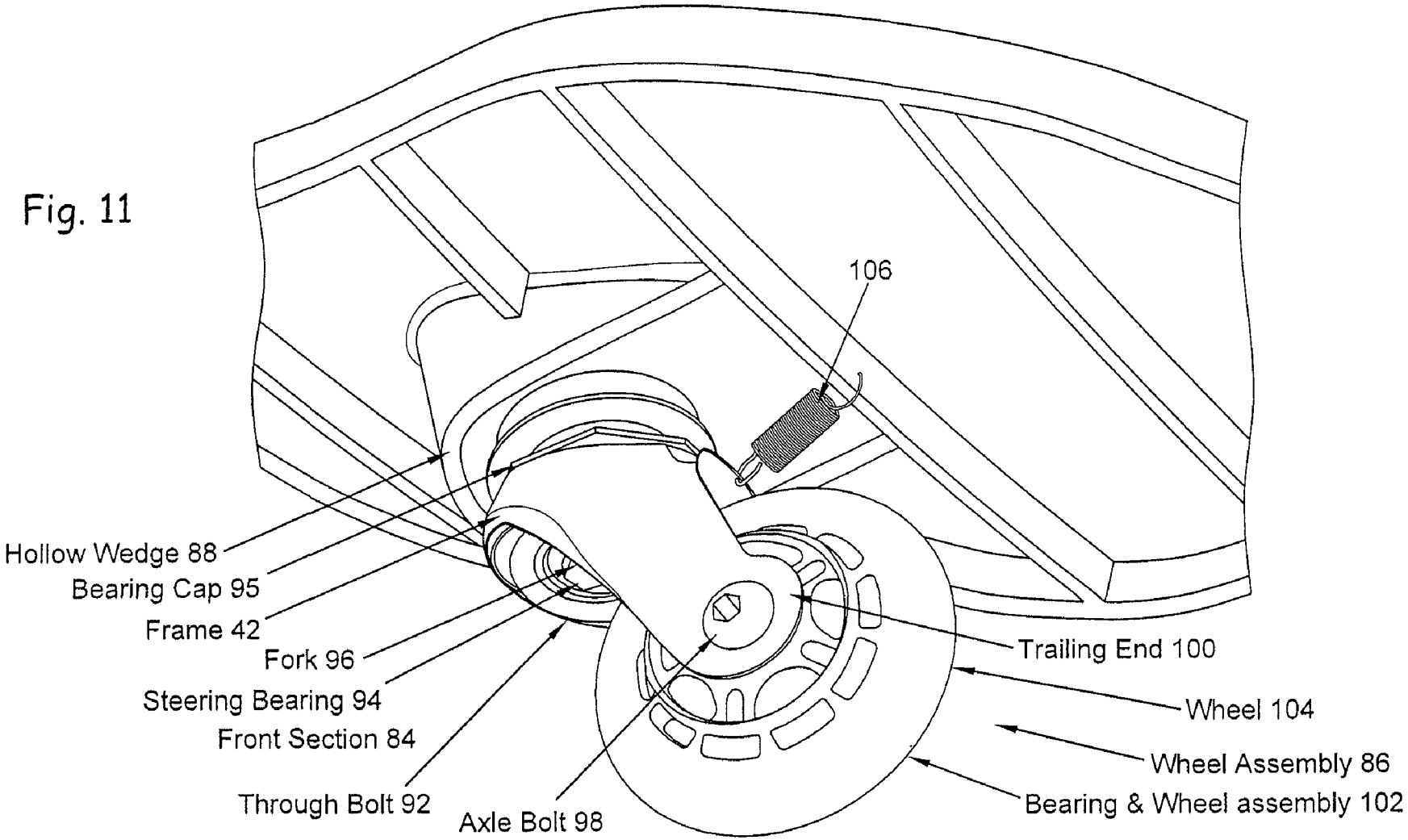
FIG. 11 is a partial view of a self centering front section 84 of board 10.

Referring now to FIG. 11, a partial view of self centering front section 84, of one piece flexible board 10, in which caster wheel assembly 86 is mounted to hollow wedge 88 formed underneath front foot support 90 of board 10. Through bolt 92, only the head of which is visible in this figure, may be positioned through the inner race of wheel assembly steering bearing 94, bearing cap 95 and the lower surface of wedge 88 and captured with a nut, not visible here, accessible from the top of platform 12 of board 10 in the hollow volume of wedge 88. The outer race of bearing 94 is affixed to fork 96 of caster wheel assembly 86, which is mounted by bearing 94 for rotation with respect to bearing cap 95, so that wheel assembly 86 can swivel or turn about the central axis (shown as turning axis 50 in FIG. 2) of through bolt 92 which serves as pivot axis 41 with respect to the fixed portions of board 10. Axle bolt 98 is mounted through trailing end 100 of fork 96 to support bearing and wheel assembly 102 for rotation of wheel 104.

In a preferred embodiment, a spring action device may be mounted between caster wheel assembly and some fixed portion of platform 12 (or of a portion of a caster assembly fixed thereto) to control the turning of fork 96 and therefore caster wheel assembly 86 about turning axis 34 to add resistance to pivoting or turning as a function of the angle of turn and/or preferably make caster wheel assembly self centering. The self centering aspects of caster wheel assembly 86 tends to align wheel 104 with long axis 28 (visible in FIG. 1) when the weight is removed from board 10, for example, during a stunt such as a wheelie. Without the self-centering function of the spring action device, caster wheel assembly 86 may tend to spin about axis 34 through bolt 92 during a wheelie so that caster wheel assembly may not be aligned with the direction of travel of board 10 at the end of the wheelie when wheel 104 makes contact with the ground. The self centering function of caster wheel assembly 86 improves the feel and handling of board 10, especially during maneuvers and stunts, by tending to align wheel 104 with the direction of travel when wheel 104 is not in contact with the ground. The spring action device may be configured to ad or not add appreciable resistance to maneuvers such as locomotion or turning when wheel 104 is in contact with the ground, depending on the desired relationship between forces applied and the resultant twist of platform 12.

As shown in FIG. 11, caster wheel assembly 86 may be made self-centering by adding coil spring 104 between fork 96 (or any other portion of caster wheel assembly 86 which rotates about the axis of bolt 92) and front section 84 of platform 12 (or any other fixed portion of platform 12).

Figure 12:
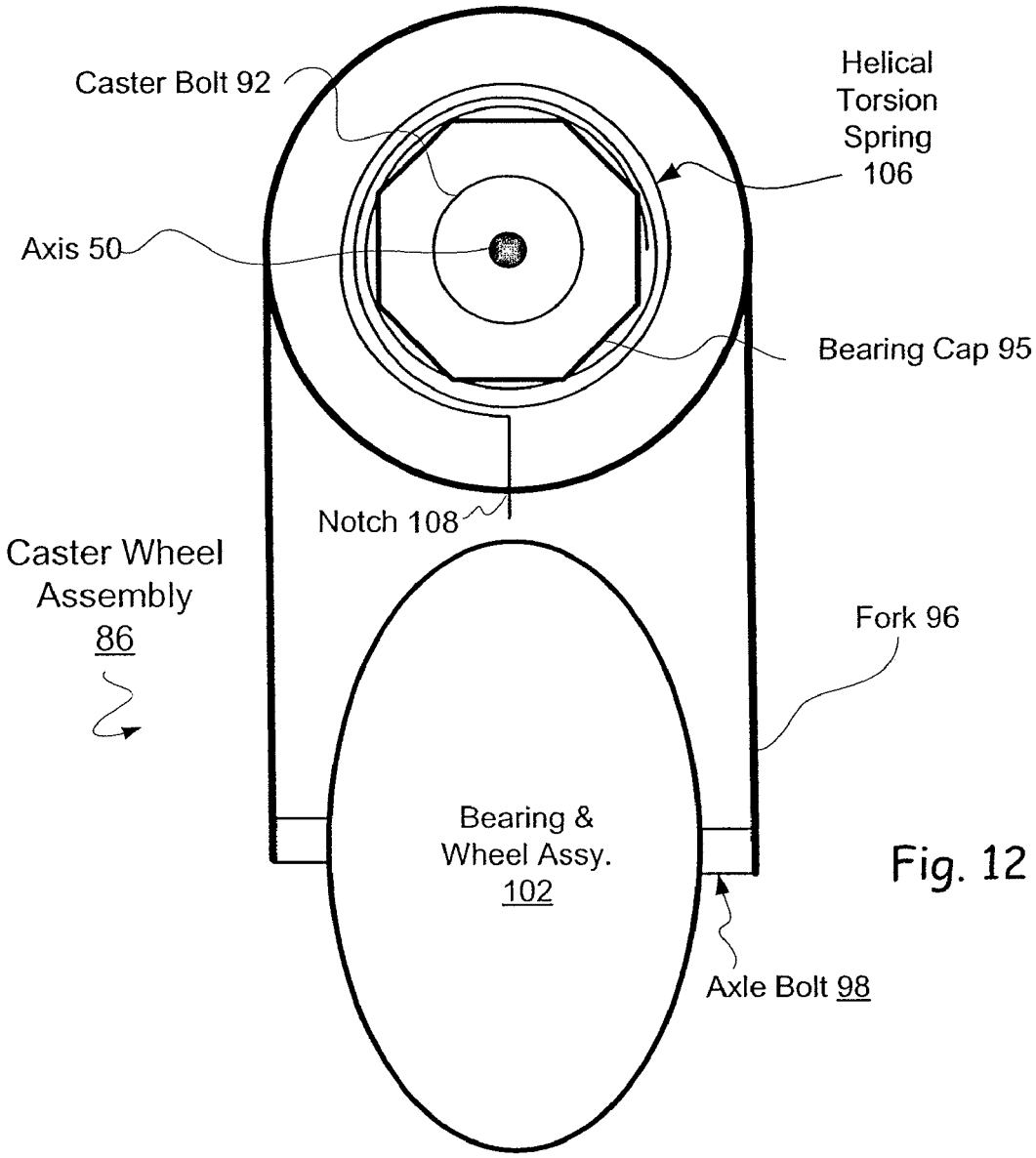
FIG. 12 is a top view of a caster wheel assembly with an external self centering torsion spring.

Referring now to FIG. 12, a partial top view of caster wheel assembly 86 is shown including bearing cap 95 (which is fixedly mounted by bolt 92 to platform 12) and fork 96 (which mounted for rotation about axis 50 through the center of bolt 92). In another preferred embodiment, self-centering of caster assembly 86 may be provided by a torsion spring arrangement, such as helical torsion spring 106. A fixed end of helical torsion spring 106 may be fastened to a fixed part of board 10 such as bearing cap 95 or platform 12, while a movable end of helical torsion spring 106 may be mounted to a portion of caster wheel assembly 86 mounted for rotation about axis 50 by for example fitting in a slot, such as notch 108 in fork 96.

Figure 13:
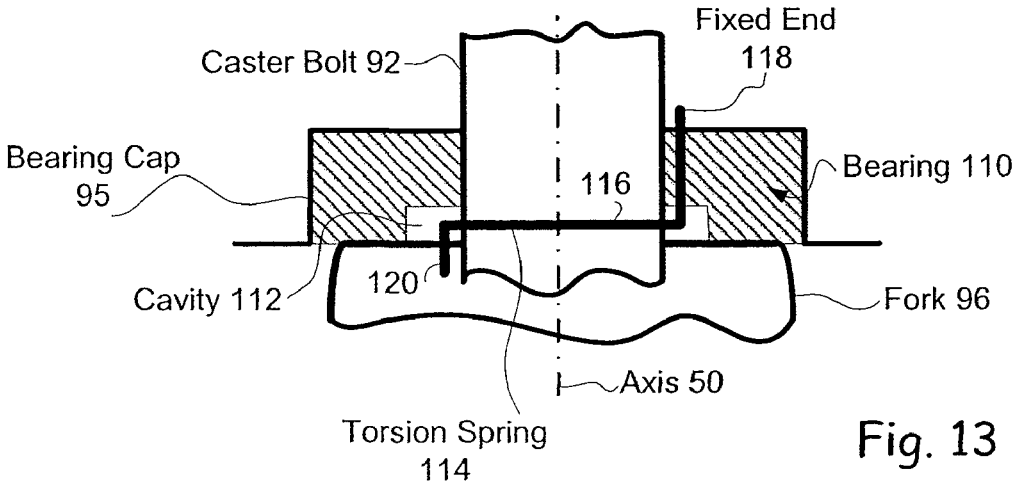
FIG. 13 is a partial side view of a caster wheel assembly with an internal self centering torsion spring.

Referring now to FIG. 13, a partial cross section view of the mounting for rotation about axis 50 through caster bolt 92 of caster fork 96 is shown in which low friction bearing 110 is positioned between bearing cap 95 and the upper surface of fork 96. Low friction bearing 110 may be a solid, such as Teflon, or a liquid, such as a grease for bearing 94, or a combination of both. Further, low friction bearing 110 may merely be an open space or cavity between bearing cap 95 and the top of fork 96 which permits fork 96 to be supported solely by the outer race of bearing 94 (visible in FIG. 11) without contact with bearing cap 95. In any event, an open area such as cavity 112, surrounding bolt 92 and positioned between the top of fork 96 and bearing cap 95, may be provided in which torsion spring 114 may be mounted for causing self-steering of caster wheel assembly 86. In particular, torsion spring 114 may include center section 116, such as a helical coil, a fixed end 118 which may be fixed with regard to rotation about axis 50 by being mounted through cavity 112 for penetration through bearing 110, if present, into bearing cap 95, or into bolt 92. The other end 120 of spring 114 is affixed to a portion of caster wheel assembly 86 which rotates about axis 50 such as fork 96.

Figure 14A:
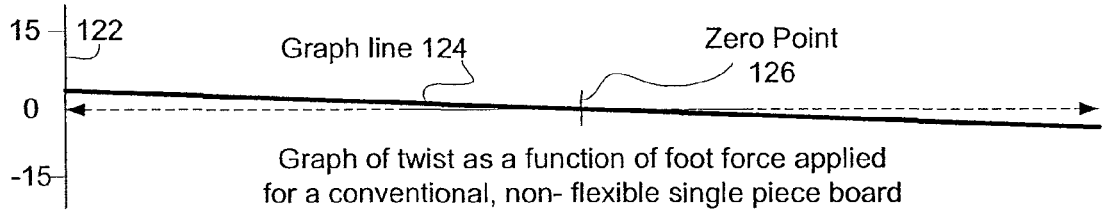
FIGS. 14A and 14B are graphical representations of board twist as a function of differential force or pressure applied by a user.
Figure 14B:
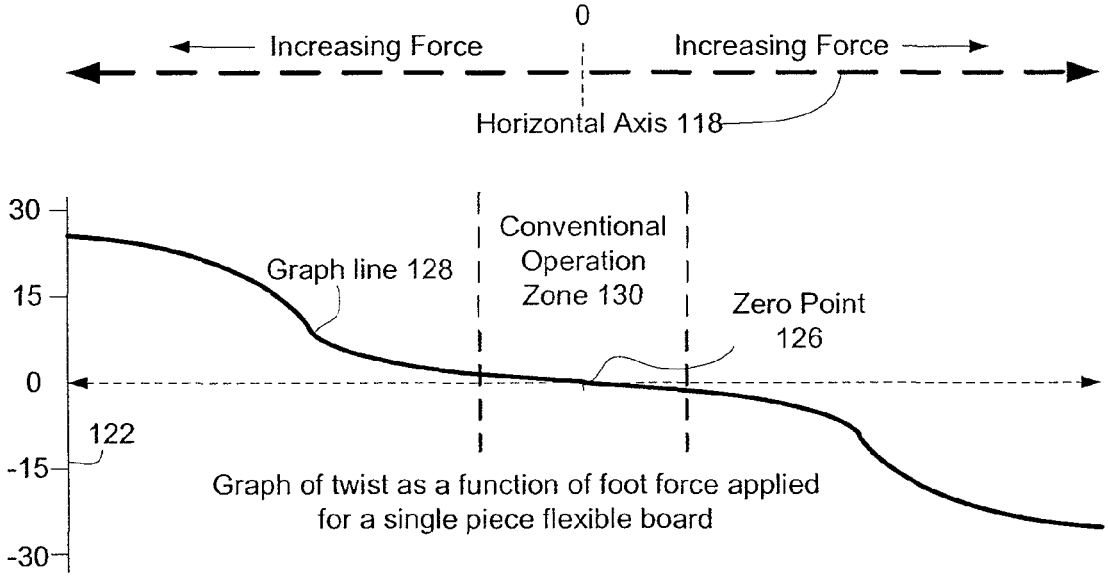
Figure 14C:
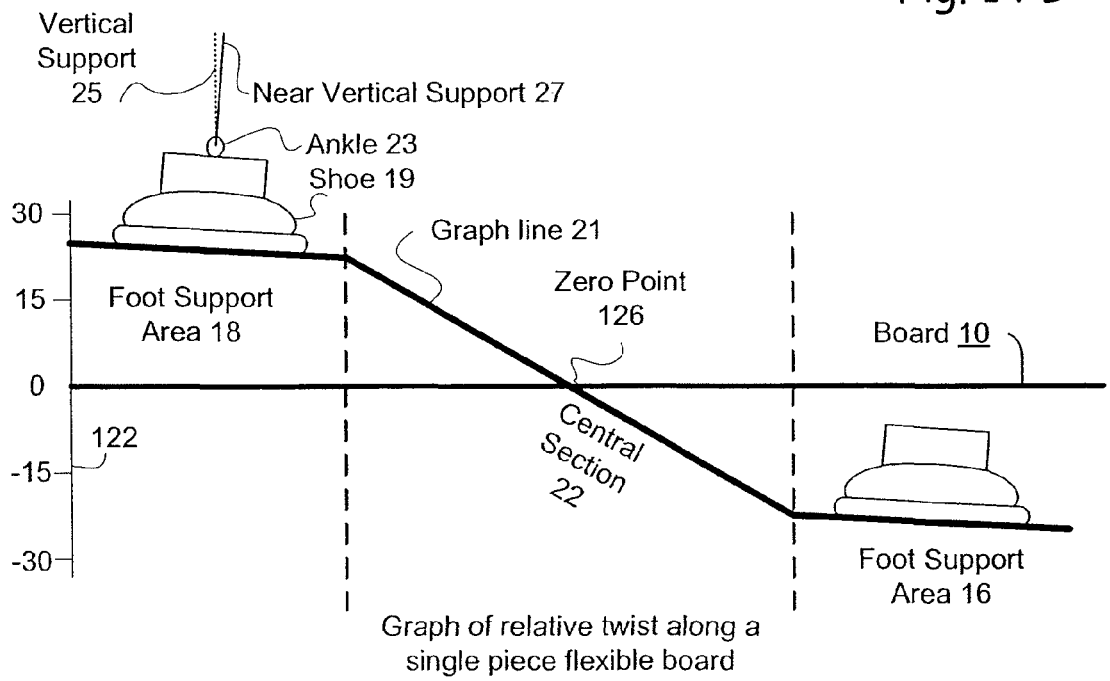
FIG. 14C is a graphical representation of relative twist along the foot support and central areas of the board.

Referring now to FIGS. 14A-C, it is important to note that board 10 with a single piece twistable platform 12 and a self centering spring may also operate differently than board 10 without a self-centering spring. In particular, the self-centering spring may also provide a pivotal rotation dampening or limiting function which improves the feel of the ride. FIGS. 14A and 14B are a pair of graphs illustrating board twisting angle as a function of the force applied by a user to twist platform 12. Horizontal axis 118, shown between FIGS. 14A and 14B, shows increasing force which may be the force that can be applied by a user, in opposite directions, to wider sections 18 and 20 to twist platform 12. Centerline 120 of horizontal axis 118 represents zero force while the outer ends of horizontal axis 118 represent the maximum forces that a user would apply to wider sections 18 and 20 in opposite directions to twist platform 12. Each of the vertical axes 122 of the graphs represent the degrees of twist of platform 12 at the ends of board 10.

Referring now to FIG. 14A, graph line 124 is used to represent the angle of twist of the ends of board 10 as a function of the force applied by the user to a conventional, non-flexible single piece skateboard. At zero point 126, there is no rotational twist even if there is substantial differential force applied by the user's feet because in the center such differential force would be balanced and therefore there would be not twist. With such conventional boards, the user may apply significant differential pressure and there will be no, or very limited, end-to-end twist. The limited flexing of such conventional boards, if any, is shown for example as an end-to-end twist on the order of perhaps about 5° or less. The limited flexure or twisting available with such conventional skateboards may be useful to absorb road bumps and vibrations in order to reduce stress and shock applied to the user's feet. This limited level of twist is not enough to provide substantial locomotion or other advantages of a flexible one piece skateboard as described herein. That is, even if the user were to complete several cycles of applying differential force or pressure in a first sense (e.g. clockwise) and then in the opposite sense (e.g. counterclockwise), the limited end-to-end twisting of the conventional board, if any, would not be enough to rotate the direction casters (if used) about their pivot angles to provide any substantial tendency to locomotion of the skateboard.

Graph line 124 is shown for convenience as a straight line, and in some boards may represent a linear variation of end-to-end twist as a function of differential force applied. However, in other boards, the function may not be linear and may for example better represented by a curve, such as a smooth curve.

Referring now to FIG. 14B, graph line 128 represents the angle of twist as a function of the differential pressure or force applied by the user to a flexible single piece board. Differential pressure or force may be the force applied to twist platform 12, for example, by applying unequal forces on opposite sides of long or twisting axis 20. As noted above, the graph line may represent either a linear or non-linear function of twist in response to differential applied force for one embodiment of a single piece flexible board. Conventional operation zone 130 represents a portion of the graph line, centered around zero point 126, in which differential pressure applied by the user will not produce sufficient end-to-end twist to cause any substantial tendency toward locomotion. The width of the conventional zone of operation zone represents the magnitude of the difference force or pressure which may be applied, for example with one foot twisting the board in a clockwise direction while the other foot twists the board in a counterclockwise direction, that can be applied to board 10 without causing the board to operate as a flexible skateboard.

If this maximum differential or twisting force, that may be applied without causing board 10 to operate as a flexible skateboard, to permit the user to feel feedback or resistance from the board, the user can more easily maintain a flat board, that is, to operate the board as a conventional board without causing board 10 to steer. Said another way, if the flexible board flexes easily about zero point 126 so that the user can't easily distinguish by feel when the board is twisting substantially or not, the user may have to make continuous adjustments to the differential pressure applied to the board in order to have the board run straight and true in a conventional manner. This range of low levels of differential pressure, if allowed to produce substantial end-to-end twist before the magnitude of the differential pressure is easily noticed and/or controlled by the user, may be considered a "dead zone" and produce substantial user fatigue merely trying to keep the board running straight. If however, as shown in graph line 128, the range of differential pressures (within which the end-to-end twist is not enough to cause the skateboard to turn or otherwise operate non-conventionally) is high enough so that the user can feel the resistance or feedback from the board, the board can easily be operated to run straight without substantial user fatigue.

In other words, it may desirable for the board to provide sufficient resistance to initial twisting so that the user can feel the resistance with his feet even when the differential pressure is low in order to reduce the fatigue and stress of operating a flexible board while going straight or steering only by tilted, as performed in a conventional, non-flexible or flat board manner. By applying more differential or twisting forces, rolling energy can be applied to the wheels and locomotion may still be accomplished by applying cycles of differential pressures providing sufficient end-to-end twist beyond the convention operation zone 130 to cause locomotion and/or aid in steering the board.

Referring now to FIG. 14C, another important aspect of the twisting of board 10 may be that the amount of twisting of the material of board 10 within each foot support area be minimized to reduce stress and fatigue for the user. For example, if the twist within a foot support area is high enough, the twist may effect the vertical angle at which the user's ankle is supported. During twisting of the material of board 10, the heel and toe motion of user's feet causes twist. If the twist in each foot support area is high enough, the angle of support of the ankles to the legs of the user be altered by the twist. For example, if it may be assumed for the purposes of discussion that all the twist in board 10 is performed within narrow section 22, each foot support area may be considered to support the user's leg in a generally vertical plane even though, of course, the ankle may be rotated fore and aft and the knee is bent. If however, significant twisting also occurs within the foot support area, for example if the user's leg is twisted further out of the vertical than would result if no twisting occurred within the foot support area, operation of the board during twisting would likely cause the user greater stress and fatigue than would otherwise occur.

A small amount of twisting of within each foot support area may however be acceptable. For convenience of illustration, user's shoe 19 is shown on foot position 18 of graph line 21 of board 10. The relative angle of twist is shown along graph line 21 from central zero point 126. That is, board 10 is assumed to have a point within central section 22 which hasn't rotated when the material of board 10 has been twisted to a maximum amount of twist, such as 50° of end-to-end-twist. The degrees of rotation about twist axis 28 increase from zero point 126 to a maximum number of degrees, such as 22.5°, at the end of central section adjacent foot support area 18. In order to reduce user's stress and fatigue, the change from the vertical support (shown as dotted line 25), as a result of twist of the material of platform 12 occurring within foot support area 18, of the user's leg above ankle 23, is limited to a small number of degrees as illustrated by near vertical support line 27.

Referring again to FIG. 2, sidewall 62 may be used to reduce the fatigue or stress of the user resulting from a bending or bowing of surface 58 of board 10. If the material of board 10 was too flexible, or not sufficiently support for example by sidewall 62 or the like to prevent bowing, the user would experience stress on his ankles if his stood too far outside of the area of support of wheel assemblies 24 and 26 because the outside of his feet would each tilt downward. Similarly, if the user stood too far inside of the support of wheel assemblies 24 and 26, his ankles would be stressed because the inside of his feet would tend to tilt downward. The tilting of the user's feet from bowing of the material of board 10 can be said to occur generally in a plane across the width of the user's body. A similarly stress may occur if too much twisting occurs within foot support areas 18 and 20. These stresses would occur as a result of a shift in the support of the user's legs too far from the vertical towards a direction part way between the plane across the width of the user's body towards a plane through each of the user's bent legs. The relative wider areas of foot support 18 and 20, compared to central section, may therefore also serve to reduce user's fatigue or stress in a similar manner as the increased height of sidewall 62 but as a result of preventing or reducing a different stress factor. For purpose of explanation, the stress on the user's foot resulting from excess twisting within a foot support area may be thought of as a twisting of the user's foot in which a forward part of the outside or inside of the foot is twisted up or down more than a rearward part of that foot.

Figure 15:
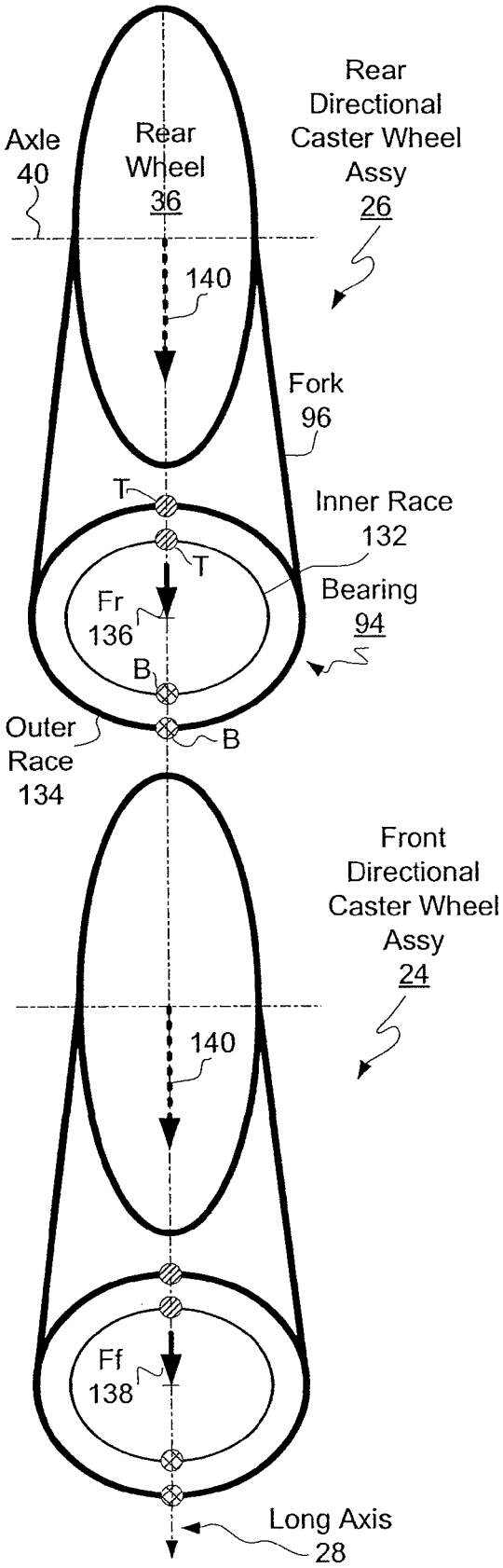
FIG. 15 is a graphical representation of caster wheel assemblies 24 and 26 with non-differential pressure or forces applied by a user along the twist axis 28.

Referring now to FIG. 15 (as well as FIGS. 1, 2 and 11) top views of front and rear directional caster wheel assemblies 24 and 26 are shown in FIG. 15 aligned along twisting or long axis 28 of the top surface 12 of board 10, shown in FIG. 1. In particular, in rear caster assembly 26, inner race 132 of bearing 94 is mounted to a fixed portion of the skateboard such as platform 12 while outer race 134 supports fork 96 in which rear wheel 36 is mounted for rotation about axle 40. The direction of rolling motion of caster 26 is perpendicular to axle 40 and is indicated as direction vector 140.

Bearing 94 is typically circular, but is shown in the figure in an oval shape because this figure is a top view and outer race 134 is mounted for pivoting rotation about axis 50 which is not orthogonal to top surface 58 of platform 12 but rather at an acute trailing angle θ2 to it as shown for example in FIG. 2. The plane of bearing 94 is orthogonal to axis 50 and therefore appears oval in this figure. Top points "T" and bottom points "B" of inner and outer races 132 and 134 are shown for ease of discussion of the orientation of caster wheel assembly 26. In particular, wedge 48, which may be hollow, is mounted with its thicker portion forward so that top point T of inner race 132 is closer to top surface 58 and bottom point B of inner race 132 is further away from top surface 58 because of the acute trailing angle θ2 of axis 50.

The range of pivotal rotation of outer race 134 about axis 50 may be limited, for example, by self centering spring 106 (shown for example in FIG. 11) if present. Bearing 94, mounted in a plane at an angle to top surface 58 as a result of wedge 48, tends to permit rotation so that top points T and bottom points B of the inner and outer races 132 are aligned.

In FIG. 15, the user is applying generally Ff 138 and Fr 136 (at front and rear foot positions 14 and 16) generally along centerline or long axis 28 as a result of which there is no differential force applied so that there is no substantial end-to-end twist applied to top platform 12 of board 10. In practice, if the level of resistance to twist of platform 12 is relatively low, e.g. so low that it is difficult for the user to feel enough feedback from the resistance to twisting of platform 12 to conveniently sense when no differential pressure is being applied, the user must work the board by applying varying amounts of differential pressure in response to non-straight motions of the board. The constant working of the board is undesirable because it causes fatigue and stress, so at least a minimum level of resistance to twisting may be desirable in a single piece, flexible skateboard.

Figure 16:
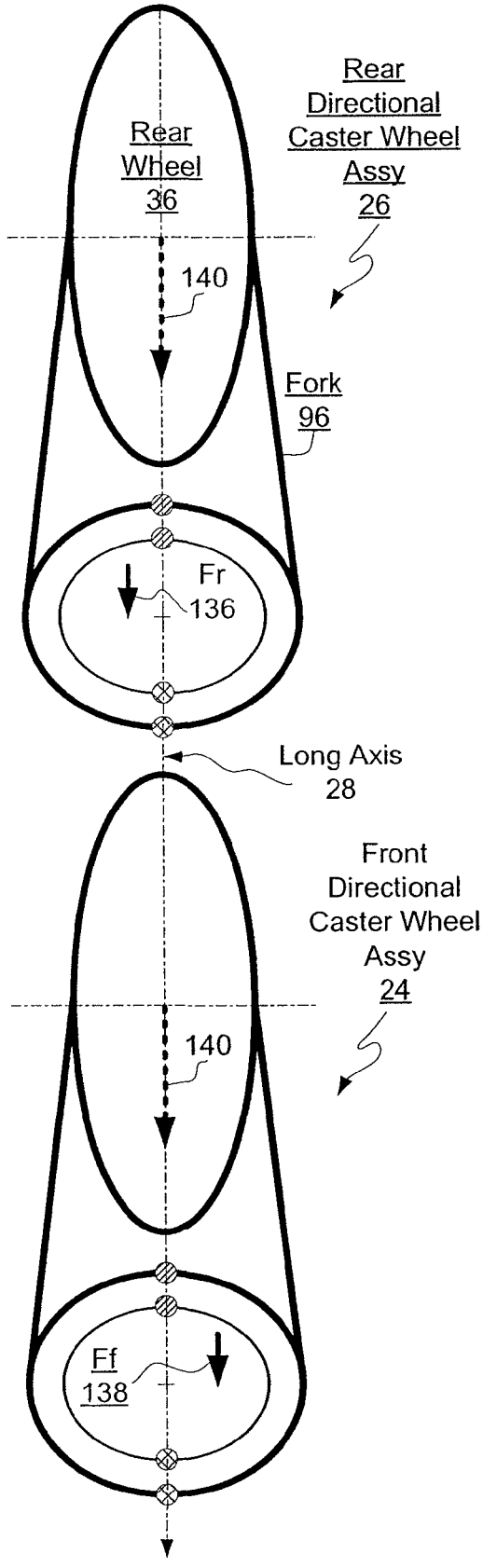
FIG. 16 is a graphical representation of caster wheel assemblies 24 and 26 with differential pressures or forces applied by a user on either side of twist axis 28.

Referring now to FIG. 16, caster wheel assemblies 24 and 26 are shown generally in the same way as shown in FIG. 15 except that front and rear foot forces or pressures Ff 138 and Fr 136 are shown applied displaced in opposite directions from twisting axis 28. In one preferred embodiment, the resistance to twisting of platform 12 may be sufficiently high that the user can easily apply at least some differential pressure to platform 12 without causing casters 24 and 26 to turn from a straight forward alignment, that is, front and rear wheels 36 may generally maintain track with long axis 28 so that board 10 operates as a conventional non-flexible board even though sufficient differential pressure may be applied by the user to get force feedback from the board's resistance to twist. As shown by motion vector 140, which is aligned with long axis 28, board 10 may run straight, i.e. operate in a convention non-flexible board manner even with some applied differential foot forces as shown. This higher level of resistance to twisting may be desirable to reduce user fatigue and/or stress.

Figure 17:
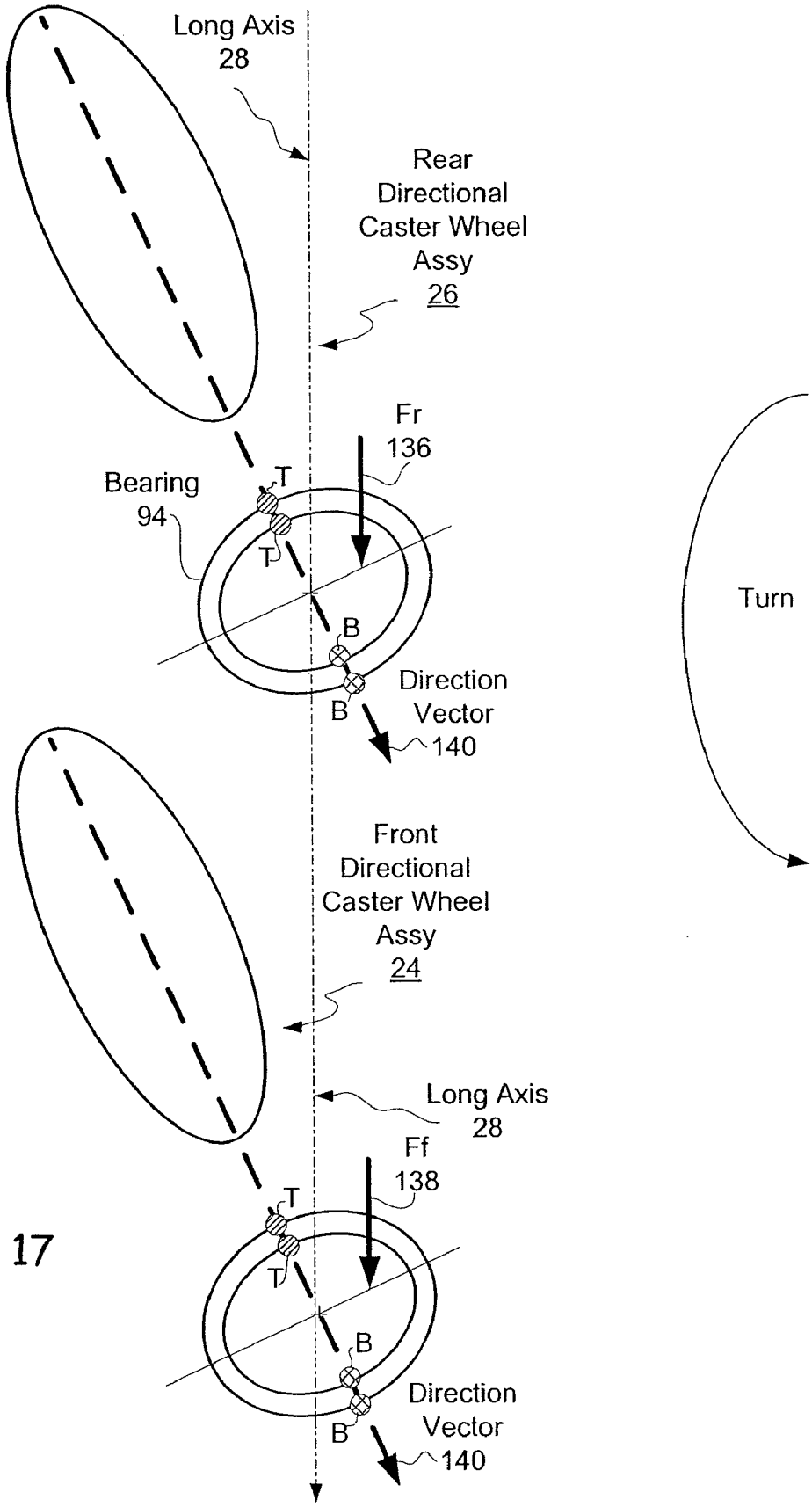
FIG. 17 is a graphical illustration of the steering of wheel assemblies 24 and 26 with non-differential pressures or forces applied by a user on one side of twist axis 28.

Referring now to FIG. 17, the user is applying substantial non-differential pressure as indicated by Fr 136 and Ff 138 which causes platform 12 to tilt. As a result, top point T and bottom point B of the inner races of bearings 94 of caster assemblies 26 and 24 are shifted by the tilt in the opposite direction from the side of long axis 28 on which forces 136 and 138. In response, the applied forces cause the pivotable portions of the caster assemblies to pivot about their axes in order for top points T and bottom points B of the outer races to become aligned with the top points T and bottom points B of the inner races, as shown. Direction vectors 140, that is the paths that the wheels would tend to roll along, are no longer parallel with long axis 28 so that board 10 tends to change direction from the direction of axis 20 towards the direction of vectors 140. The actual turn resulting from non-differential forces 136 and 138 may depend on many factors, including the shape of wheels 36 as well as wobble and similar factors, but may be used at least in part for steering.

This above described operation of board 10 where steering of board 10 results from a tilting of platform 12 may be considered to be within the zone of conventional operation of a non-flexible skateboard, that is, board 10 may feel to the user to be similar to the feel of a conventional board. It should be noted however, that, non-flexible, conventional skateboards using wedges and/or directional casters, may typically be configured with the wedges facing in opposite directions so that the rear wheel is forward of the rear wheel pivot point and the front wheel is aft of the front wheel pivot point.

Figure 18:
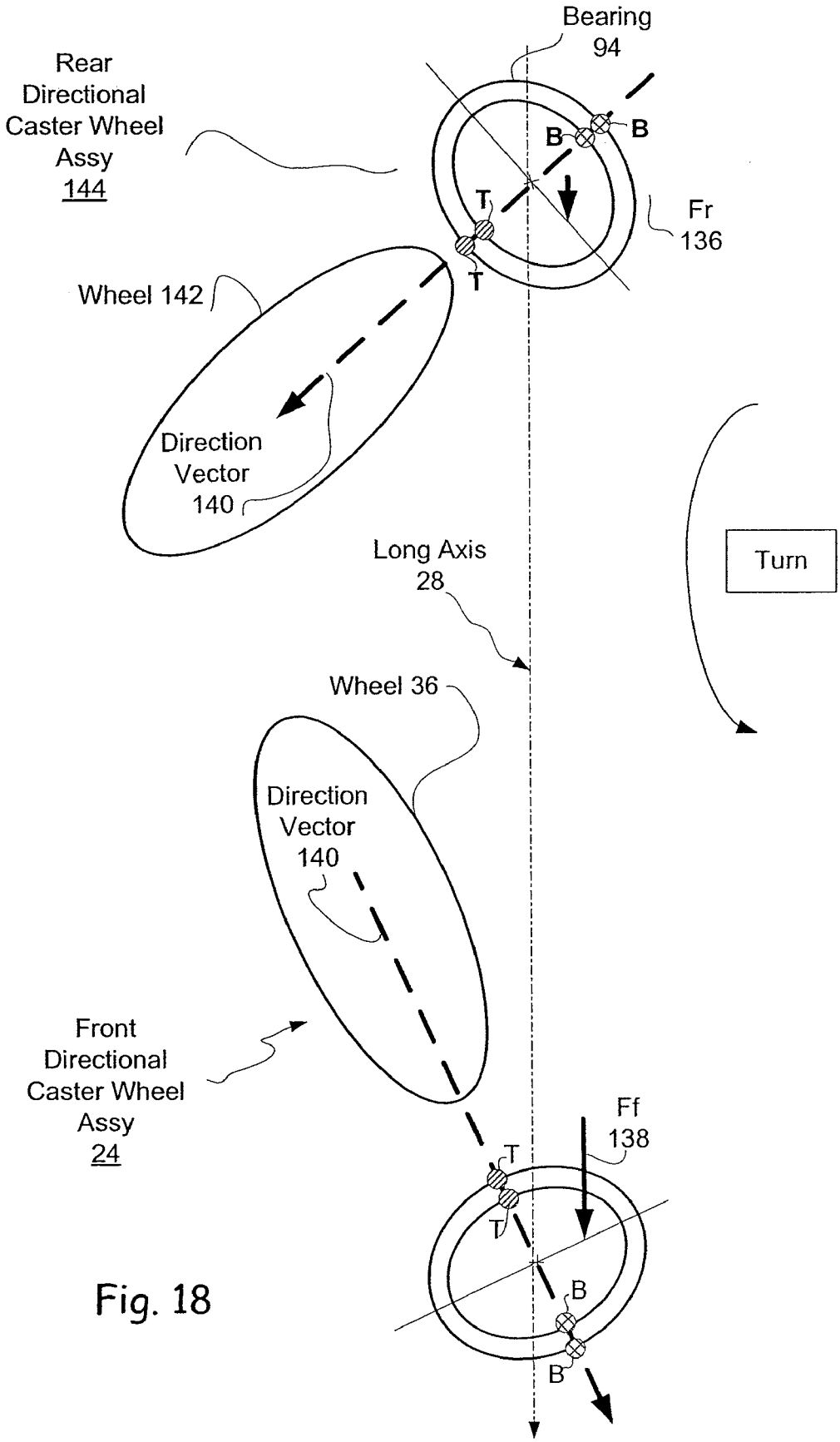
FIG. 18 is a graphical illustration of the steering of wheel assemblies 24 and 144 having non-parallel pivot axes with non-differential pressures or forces applied by a user on one side of twist axis 28.

Referring now to FIG. 18, caster wheel displacement for such a design is shown for comparison. In such a configuration in which the pivot axes of the front wheels are not generally aligned with each other, e.g. the pivot axes are not both at a similar acute angle to top surface 12, non-differential foot pressure to the same side of long axis 28 may cause wheel 36 of front caster assembly 24 to rotate in a first sense (e.g. counterclockwise) as shown while causing wheel 124 of rear directional caster assembly 144 to rotate in the opposite sense (e.g. clockwise) as shown. The resultant turn as shown would be counterclockwise, following the front wheel.

Figure 19:
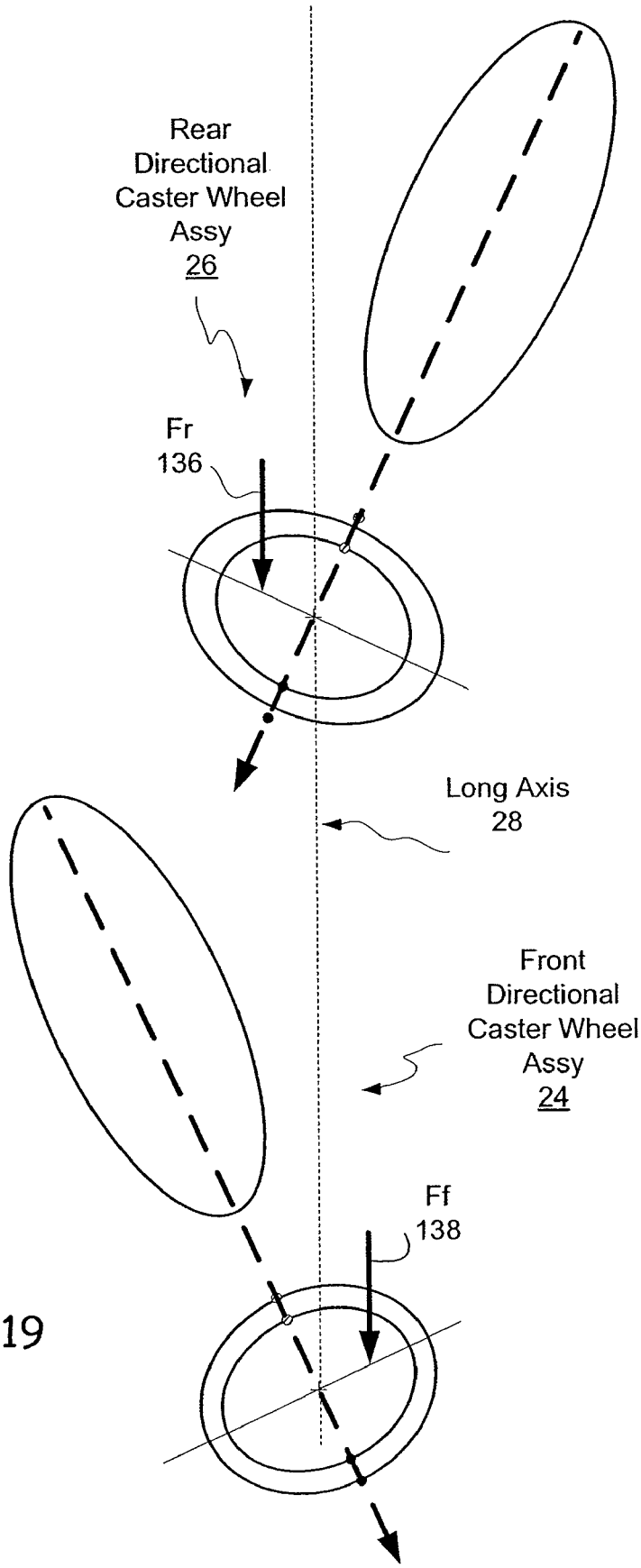
FIG. 19 is a graphical illustration of the steering of wheel assemblies 24 and 26 having parallel pivot axes with differential pressures or forces applied by a user on both side of twist axis 28.

Referring now to FIG. 19, a flexible single board skateboard using directional casters pivoted along generally aligned trailing axes may be steered by applying differential pressure, for example, forces Fr 136 and Ff 138 to opposite sides of long axis 28 which causes the directional casters to rotate in opposite directions to steer and/or locomote skateboard 10. It should be noted that in practice, board 10 may well be steered using a combination of differential pressure or twisting forces, as well as some level of tilt.

Referring now to FIGS. 14 through 19, in a preferred embodiment, the resistance to twisting of platform 12 may be sufficient to conveniently operate the skateboard in a straight line manner as shown in FIGS. 15 and 16 with forces applied along long axis 28 or in a non-differential manner with roughly equal forces applied on opposite sides of long axis 28. Similarly, board 10 may be steered by tilting platform 12 in response to applying forces from both feet to the same side of axis 28. These three operations may be considered as operations in conventional zone 130 of FIG. 14, that is, operations which are the same or similar to operations of a non-flexible. The operation shown in FIG. 19 may be considered an operation outside conventional zone 130 in that twisting platform 12 causes the wheel assembly to pivot in different directions. Platform 12 may also be tilted when twisted.

Single piece platform 12 may be configured from multiple pieces of plastic material which are fastened together, for example by nuts and bolts, so that platform 12 twists as if it were molded from a single piece of plastic material.

Figure 20:
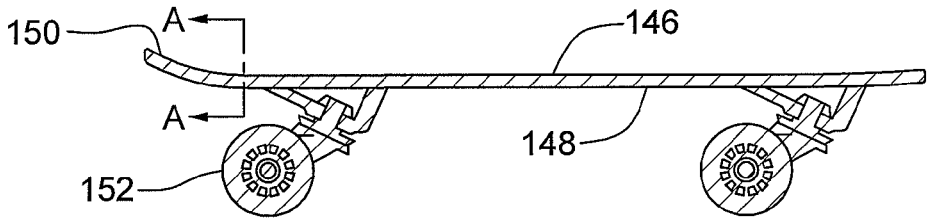
FIG. 20 is a side view of an alternate embodiment in which one piece flexible skateboard 146 is formed by molded wooden deck 148 provided with integral kick tail 150.

Referring now to FIG. 20, flexible skateboard 146 may be configured with a single piece, molded wooden platform such as platform 148 with molded in kick tail 150. Kick tail 150 is a portion of wooden platform 148 extending well beyond rear wheel 152 so that a rider can apply pressure with one foot to kick tail 150 to alter the performance of skateboard 146 by for example kicking the tail of skateboard 146 down to contact the ground to stop or alter the direction of travel. Wooden platform can conveniently be made by molding plywood by vacuum, steam or other conventional processes. In addition to molding kick tail 150, it may be convenient to mold in a symmetrical side to side shape as shown in FIG. 21.

Figure 21:
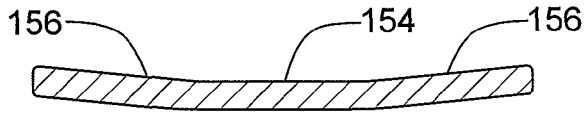
FIG. 21 is a front view of a cross section of skateboard 146, taken along line AA as shown in FIG. 20.

Referring now FIG. 21, a front view of a cross section of skateboard 146, taken along line AA as shown in FIG. 20, illustrates one side to side shape which may be molded into wooden platform 148 of skateboard 146 for example at kick tail 150 or along the length of platform 148. The illustrated cross sectional shape includes a center flat section 154

Figure 22:
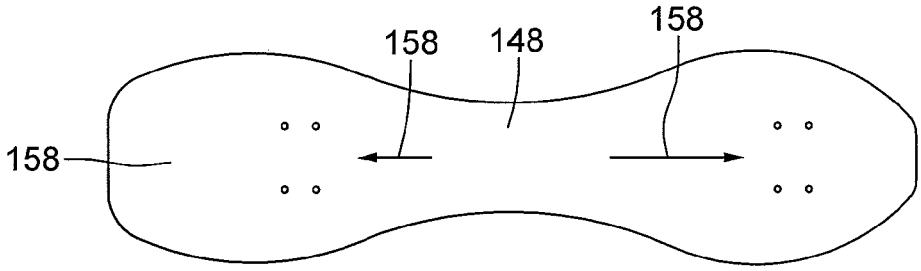
FIG. 22 is a top view of wooden platform 148 illustrating overall shape including a top view of kick tail 150.

Referring now to FIG. 22, a top view of wooden platform 148 is shown illustrating the overall shape including the top view of kick tail 150. A preferred longitudinal grain direction for the wood or plywood from which platform 148 is molded is illustrated by grain direction arrows 158. A longitudinal grain direction will allow wooden platform 148 to better resist damage, for example by splintering, when twisted during operation of skateboard 146. The use of a longitudinal grain direction in the majority of the layers of a plywood board, for example the top and bottom layers of a 3 layer plywood board, used for making wooden platform 148 may be particularly advantageous.

Figure 23:
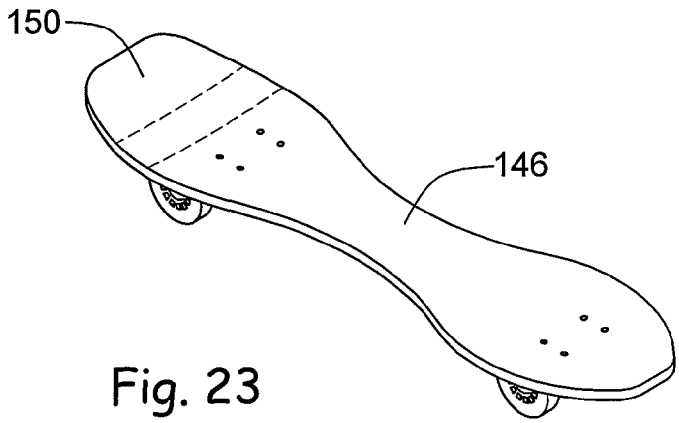
FIG. 23 is an isometric view of skateboard 146 including kick tail 150.

Referring now to FIG. 23, an isometric view of skateboard 146 including kick tail 150 is provided for clarity.

Figure 24:
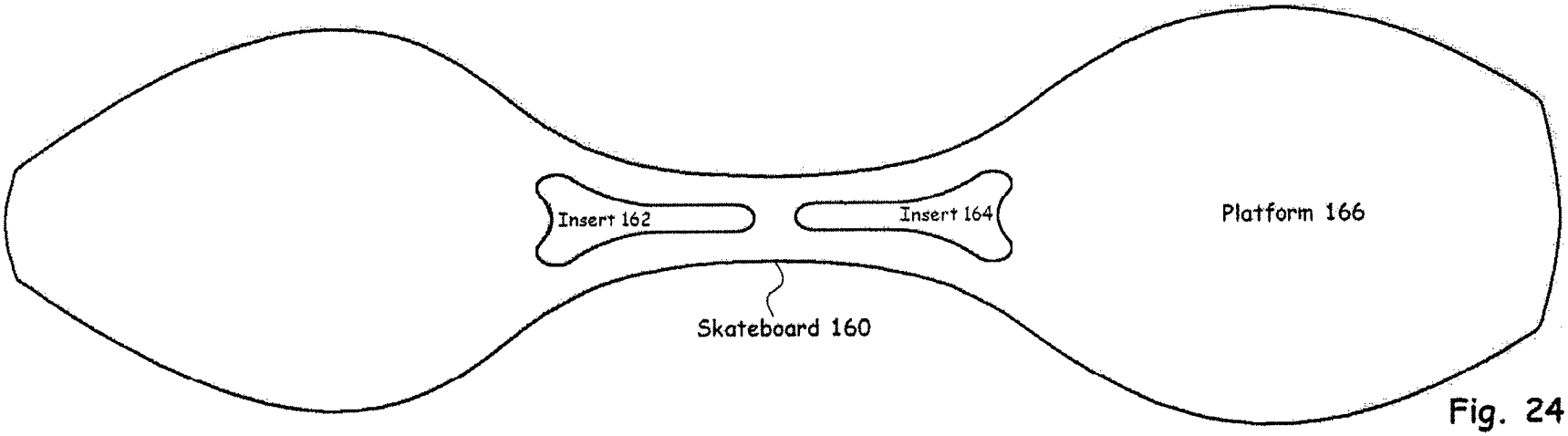
FIG. 24 is a top view of an alternate embodiment in which skateboard 160 may include a pair of center section inserts 162 and 164 in platform 166 for controlling the flexure of platform 166.

Referring now to FIG. 24, a top view of an alternate embodiment is shown in which skateboard 160 may include a pair of center section inserts 162 and 164 in a pair of through holes in platform 166 for controlling the flexure of platform 166. The inserts are shown in FIG. 24 positioned in the pair of through holes which are positioned generally along the elongate axis of platform 166 and are shown bisected at the center of skateboard 160. The pair of holes may be used, with or without inserts 162 and 164, to alter the flexibility of skateboard 160 to twisting. Inserts 162 and 164 may be inserted in the holes to control the flexibility of platform 166. If the material from which the inserts are made is more flexible than the material from which platform 166 is made, skateboard 160 would have more flexibility than if the inserts were removed, but less flexibility than if the holes were not present.

Similarly, if the material from which inserts 162 and 164 are made are less flexible than the material of platform 166, the presence of the inserts would tend to reduce the flexibility of skateboard 160 to twisting forces applied, for example, by a skateboard rider pumping skateboard 160 to cause locomotion. The resilience of inserts 162 and 164 may also be used to control or affect the operation of board 160. For example, if the inserts are made of a material which crushes temporarily when forces are applied, board 160 would flex differently than if the inserts were not present. In particular, board 160 would flex when twisting forces were applied more slowly than it would return to its original shape when the twisting forces were removed because the original twist would be resisted by the crushing of the foam, but the return would likely not be resisted by the foam because it would stay crushed at least for a short time.

Alternately, if inserts 162 and 164 were made of a springy rubber, the twisting of board 160 would be affected by the response of the rubber, for example, springing back more quickly than if the inserts were not present. Further, under some circumstances it may be desirable to use only one of the inserts. For example, if insert 162 were present with out insert 164, the flexibility of on end, such as the front, of skateboard 160 can be controlled to be different than the flexibility of the rear of the board. That is, the flexibility of the board with respect to twisting forces applied by the leading foot of the skateboard rider could be adjusted at least somewhat with respect to the flexibility of the board with respect to twisting applied by the other foot of the rider. The wheels, not shown in the figure, under the front and rear of platform 166 allow forces applied to the front and rear sections of the board to be at least to some degree somewhat isolated from each other and thereby affected by the material of insert 162 and 164 if present. In a further embodiment, a different material may be used for inserts 162 and 164 for more precise control of the relative flexibility of the front and rear of the skateboard 160.

The rounded, somewhat dog-bone shape of the inserts and the holes through the platform in which they may be mounted reduces the likelihood of stress fractures and weaknesses in platform 166 from flexure.

Figure 25:
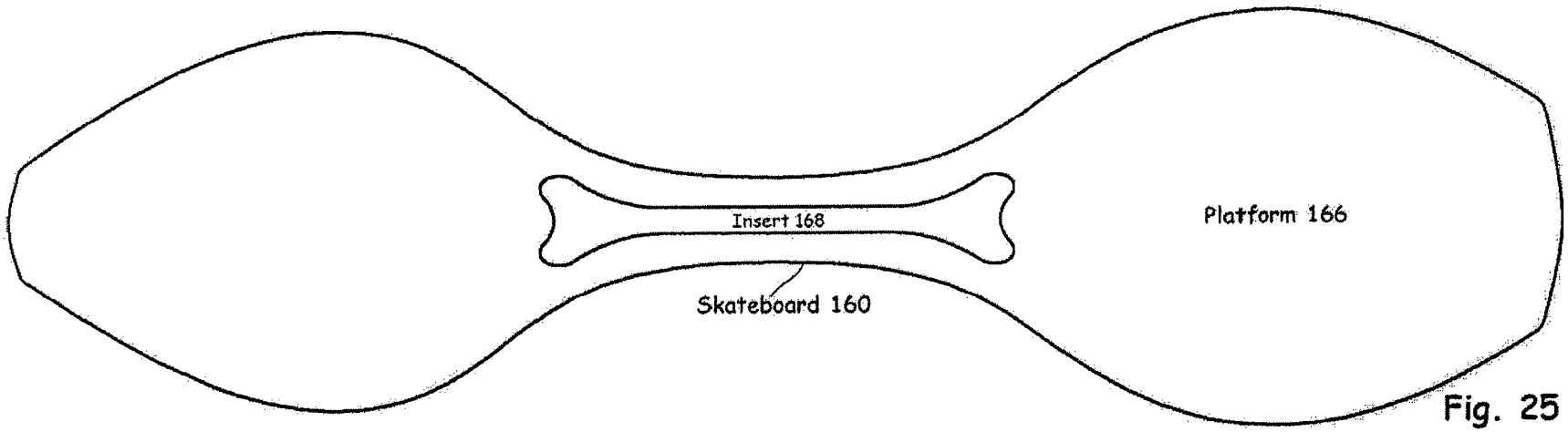
FIG. 25 is a top view of an alternate configuration of skateboard 160 shown in FIG. 24 in which a single center section insert may be employed.

Referring now to FIG. 25, a single insert 168 may be positioned in a single hole through the platform in lieu of the pair of inserts shown in FIG. 24 or the hole may be used without insert 168.

Referring now to FIGS. 26 through 29, a further embodiment is shown in which skateboard 170 includes platform 172 which may have a partial peripheral well along the outboard edges of the front and rear foot positions. A grip bar, such as rubber, may be positioned in the peripheral wells for better gripping by the rider's feet. The partial peripheral well may include an inner downward wall, a trough bottom, and an upward outer wall. The inner and outer peripheral well walls may be used to increase the resistance to flexing of the foot position portions of platform 172. A pair of downward wall along the central section of platform 172 may be used to reducing the flexing of the central section. An insert may be positioned between the downward walls surrounding the central section of platform 172 to further control the flexing of the central section in response to twisting forces applied, for example, by the rider.

Figure 26:
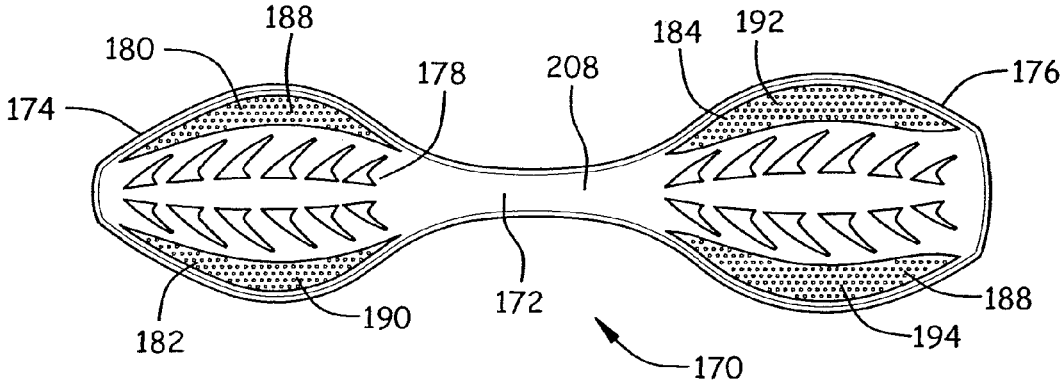
FIG. 26 is a top view of an alternate configuration of skateboard 170 including a textured surface and a series of partial peripheral wells in which inserts, such as rubber gripper bar inserts 188, 190, 192 and 194 may be positioned.

Referring now more specifically to FIG. 26, platform 172 includes front section 174 and rear section 176 forming front and rear foot positions. A central area of the front and rear sections have a textured surface 178 which may conveniently be formed in the material of platform 172 when it is molded or otherwise formed. Platform 172 may preferably be formed of a molded plastic or wood, such as plywood, and therefore not have as strong a gripping surface as may be desired at times for a skateboard. Partial peripheral wells 180 and 182 may be formed along the outer edges along front section 174 while partial peripheral wells 184 and 186 may be formed along the outer edges of rear section 176. The peripheral wells may be filled with a material providing a good gripping surface, such as rubber, for contact by the foot and/or heel of the rider's feet. The material may be in the form of an insert which could be replaceable by the rider such as front and rear inserts 188, 190, 192 and 194 respectively. The inserts may be made from rubber, plastic, metal alloys or similar materials.

In use, the shape and width of the rubber inserts may be configured so that during normal riding, e.g. when skateboard 170 is being controlled in a straight and unbanked manner, or even while turning in a relatively gentle banked turn, the bulk of the user's weight may be applied to central areas 178 so that the user's feet may be quickly and easily moved to change position of the rider's feet to change the forces being applied to the skateboard for control. In this way, the rider may also easily change and adjust foot positions without a substantial gripping contact with the rubber inserts.

During a maneuver, however, for example when the rider is applying downward pressure with the ball of one foot and the heel of the other, the additional pressure of the ball and heel applying the downward pressure may preferably cause those portions of the rider's feet to make contact with the rubber inserts, as well as the textured central areas, increasing the gripping force between the active portion of the foot and the board. The contact, for example, between the ball of one of the rider's feet with a gripping surface while that foot is applying downward pressure may provide useful additional control for the rider. In an optimal configuration, the rider may be able to control the gripping force by foot placement and pressure between the lower gripping force when the rider's foot only contacts the textured surface of the molded platform and the greater gripping force when at least one portion of the rider's foot is also contacting the rubber insert.

Figure 27:
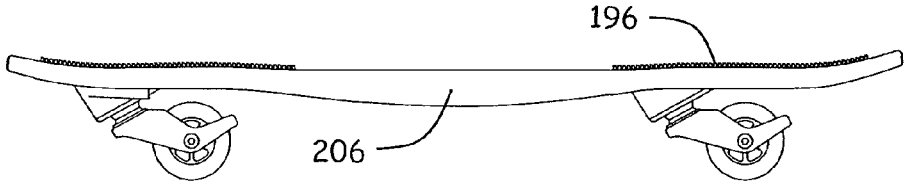
FIG. 27 is a side view of skateboard 170 shown in FIG. 26.

Referring now also to FIG. 27 in greater detail, the upper surface of rubber inserts 188, 190, 192 and 194 may be specifically textured, for example, to increase the gripping force between the insert and the rider's foot. Gripping projections 196 may be formed in the upper surface of the rubber inserts to increase gripping forces. The material from which the gripping projections, and/or the fill or insert material, may be selected to control the gripping force in light of the typical or expected materials to be used on the soles of the rider's shoes.

Figure 28:
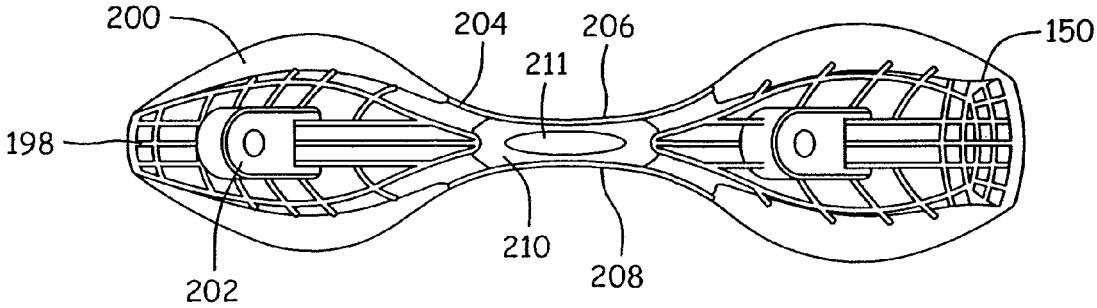
FIG. 28 is a bottom view of skateboard 170 shown in FIG. 26.

Referring now also to FIG. 28 in greater detail, the underside of platform 172 is shown which may include ribbed central section 198, extending between troughs 200 of wells 180 and 182 of front section 174, for added strength. A similar configuration may be provided on the underside of rear section 176 as shown. Ribbed section 198 is generally underneath central area 178 of front section 174 which may have surface texturing related to the ribbing and/or formed by the molding process. Wheel mounting structure 202 may be surrounded by and/or supported by the ribbing in section 198.

The upward wall sections of well 180, for example, join together at wall transition point 204 and join a downward wall, such as sidewall or rib 206 along the edge of skateboard central section 208. A pair of downward walls 206 form a portion of one or more chambers underneath skateboard central section 208 of platform 172 which may be filled by one or more inserts, such as central insert 210. As discussed above in greater detail with respect to FIG. 10 and wedges 82, central insert 210 may be used to at least partially control the flexing of the skateboard and may be inserted and/or removed by the rider based, for example, on the rider's skill and/or difficulty of a particular maneuver.

Figure 29:
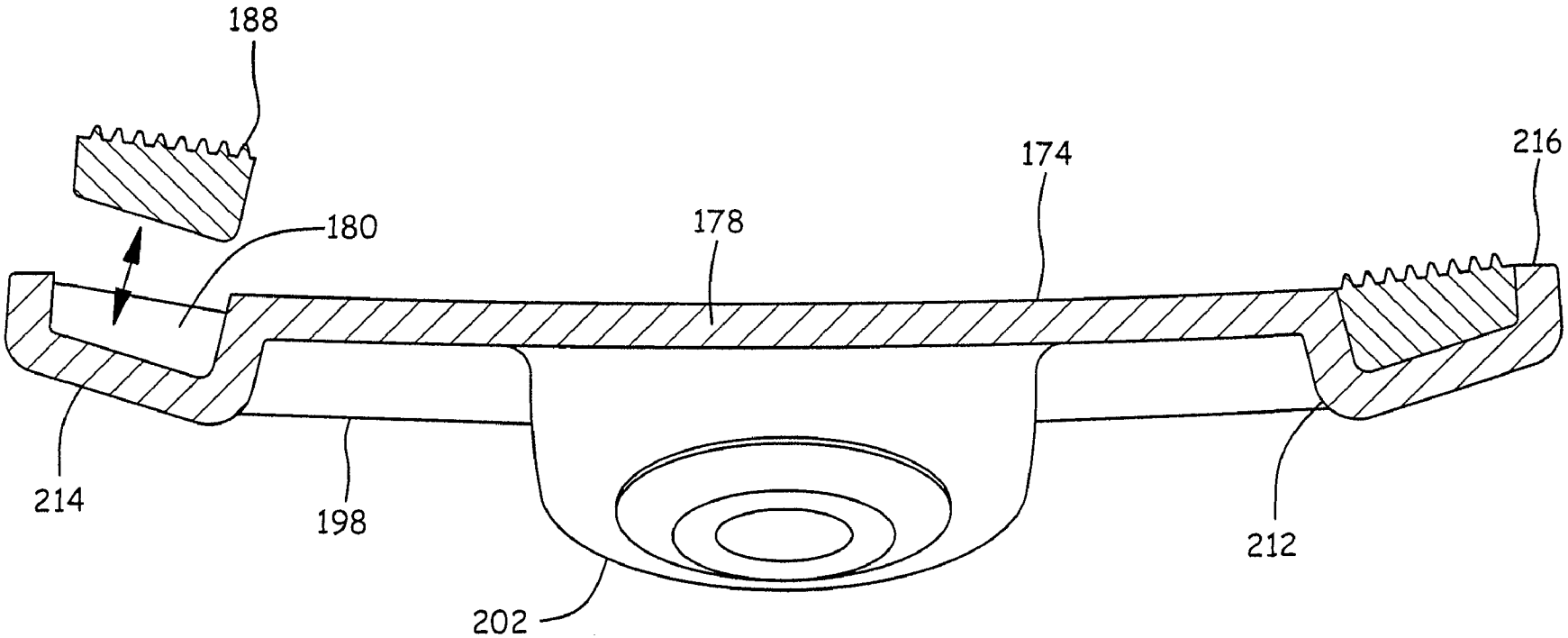
FIG. 29 is a cross sectional view along line AA in FIG. 27.

Referring now in greater to FIG. 29, a cross section of front section 174 is shown, taken along lines AA in FIG. 27. As shown the textured central area 178 of front section 174 is generally flat but preferably has a slightly concave upwards shape for strength. Wheel mounting structure 202 is positioned below central section 178 and may be at least partially supported by ribs 198. Along the periphery of front section 174, partial peripheral well 180 is formed by inner downward sidewall 212 along central section 178, trough bottom 214 and upward outer sidewall 216. Rubber grip bar 188 may be positioned in well 180. The use of a pair of upward and downward sidewalls 212 and 216 may provide substantially greater strength, and/or resistance to twisting, for the front and rear sections of platform 172 than is easily achievable using the same materials and a single sidewall as shown above in the earlier figures. The use of the shape, material and fit of insert grip bar 188 may also be used to control the resistance to twisting of the front and rear sections.

It should be noted that the use of upwardly open wells, such as partial peripheral well 180, joined at wall transition points, such as point 204, to downwardly opening chambers such as central insert chamber 211, permits greater control of the resistance to twisting forces of the front, central and rear sections 174, 208 and 176 respectively than the use of a single wall as shown in earlier figures. In addition, the relative resistance to twisting between these sections of platform 172 can also easily be controlled so that the twisting may, for example, be generally confined to the central sections and/or the front and/or rear sections of the skateboard. The use of inserts further enhances the control of resistance to twisting forces of platform 172 and/or the relative resistance to twisting forces of the front, central and rear sections of platform 172 and provides the rider the ability to alter the relative and total resistance to twisting after purchase of skateboard 170. Similarly, the transitions from a central downward facing sidewall to the pair of downward and upward facing sidewalls in which the outer sidewalls transition directions, between upward and downward facing, twice on each side of skateboard 170, also greatly enhance the strength and rigidity of the skateboard for a particularly size and material used for platform 174.

Referring now to FIGS. 30 to 37, side, top, bottom and isometric views are shown of a telescopic or extendible embodiment of flexible skateboard 220 including male section 220 and female section 224. As shown for example in FIGS. 30 and 31, in a preferred embodiment, male section 222 is the rear section of skateboard while female section 224 is the front section of skateboard 220, when assembled. Caster wheel assembly 226 may be mounted to front or rear sections 224 or 222 at an angle to the horizontal, so that caster wheel assembly 226 pivots for steering about pivot axis 228, by being mounted to hollow triangular mounting structure or cavity 230 which may be conveniently be molded into front section 224. Wheel assembly 226 includes yoke assembly 232, mounted for pivotal rotation about pivot axis 228, which supports castor wheel 234 for rotation about wheel axle 236. Axle 236 is preferably offset from pivot axis 228, as shown, by a distance on the order of the radius of caster wheel 234 so that caster wheel assembly 226 operates as a trailing caster wheel. In a preferred embodiment, caster wheel mounting structure 230 is positioned as far forward as possible to front section 224 to minimize the overall length of skateboard 220 when collapsed or closed.

Figure 30:
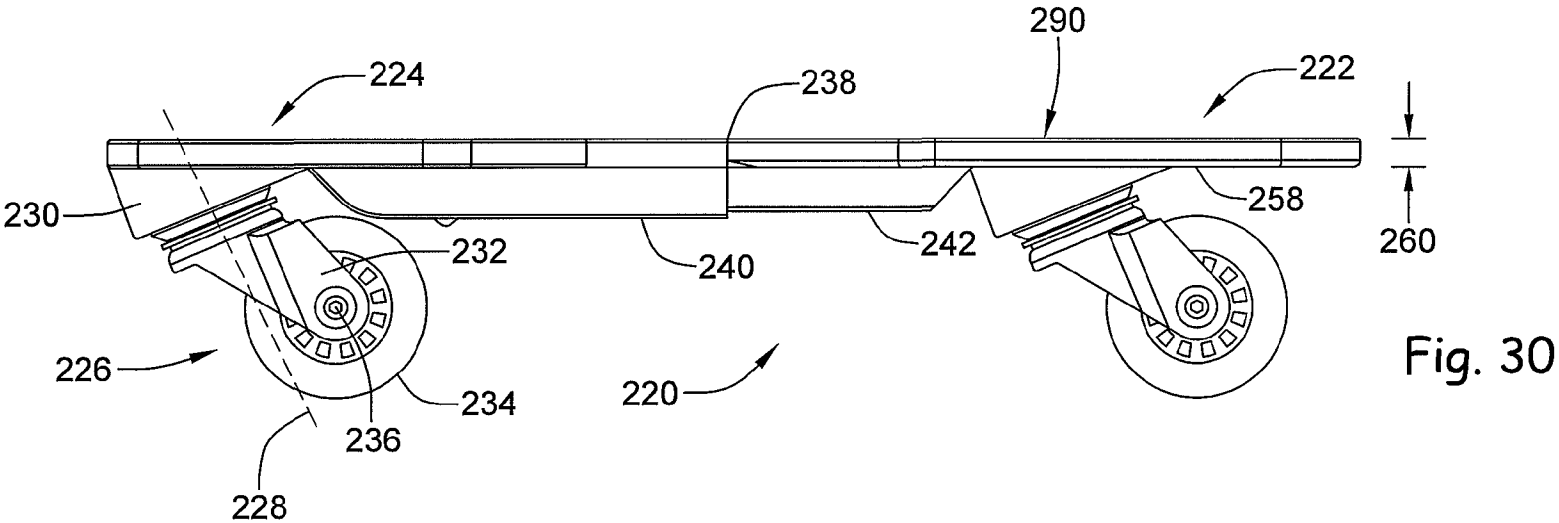
FIG. 30 is a side view of a telescopic caster board in the closed position.

A caster wheel assembly similar to or the same as caster wheel assembly 226 may be mounted to a similar hollow triangular structure in rear section 222, as shown in FIG. 30.

Figure 31:
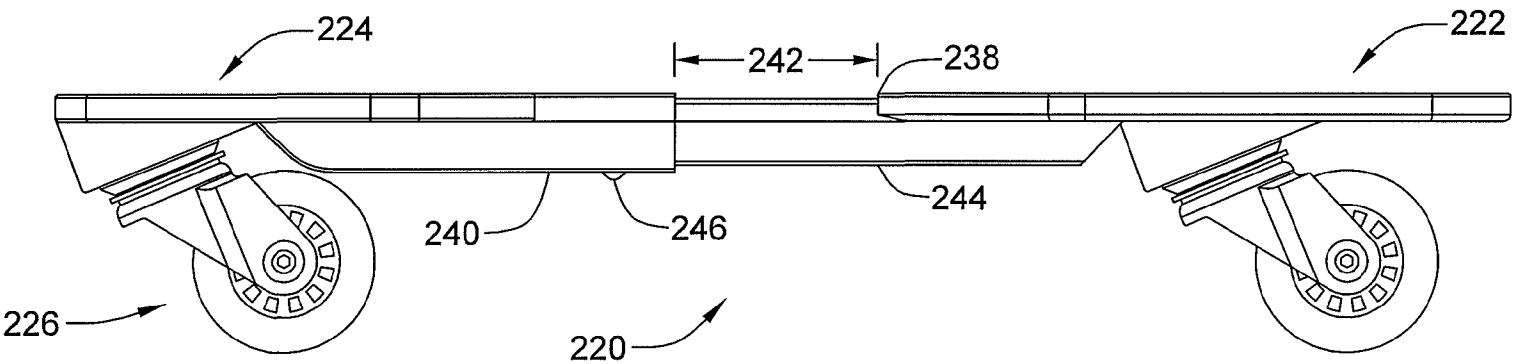
FIG. 31 is a side view of the telescopic caster board in the extended position.

When skateboard 220 is in the closed or collapsed position, as shown for example in FIG. 30, the visible portions of front and rear sections 224 and 222 meet at point 238. A portion 242 of tongue 244 of rear section 222 is positioned within hollow chamber 240 of front section 224 when skateboard 220 is collapsed and exposed when skateboard 220 is extended as shown in FIG. 31. Tongue 244 of rear section 222 fits slidably within hollow chamber 240 of front section 224.

Front and rear sections 224 and 222 are preferably molded from a plastic material selected for strength, durability and degree of flexure and may also be made from wood selected for the same qualities. Tongue 242 is preferably molded as an integral portion of rear section 222 and hollow chamber 240 is preferably molded as an integral portion of front section 224. Tongue 242 and hollow chamber 240 may also be made of a flexible material and fastened to front and rear sections 224 and 222, respectively. Extension control 246 may be used to maintain skateboard 220 releasably locked in a collapsed or extended configuration as well as in various intermediate partially extended configurations.

Figure 32:
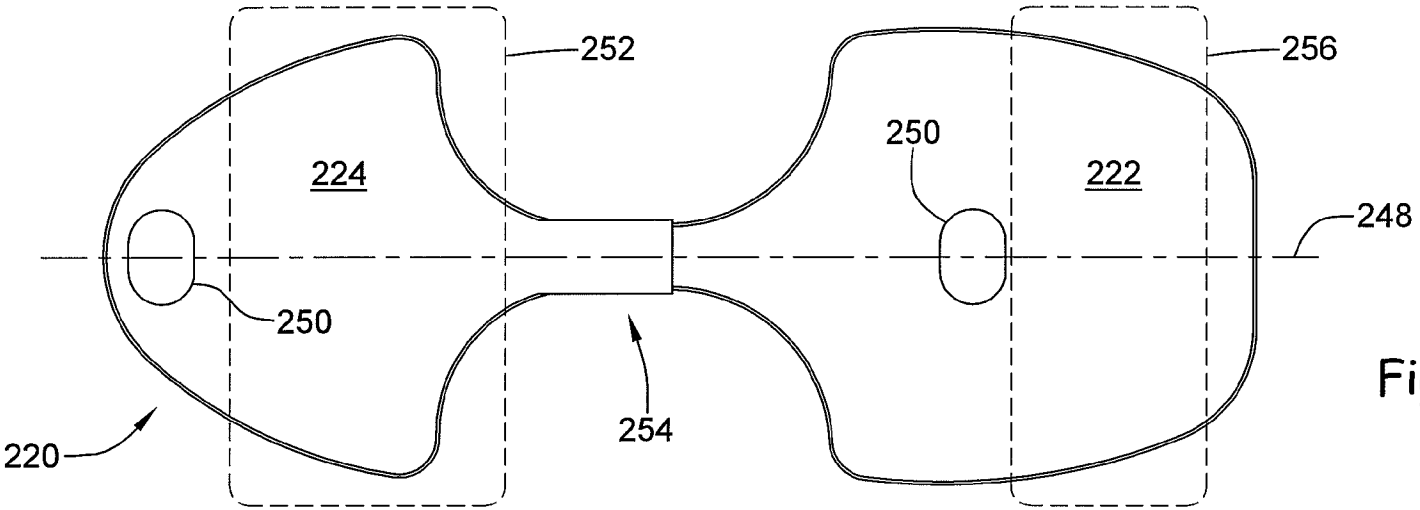
FIG. 32 is a top view of the telescopic caster board of FIG. 30.
Figure 33:
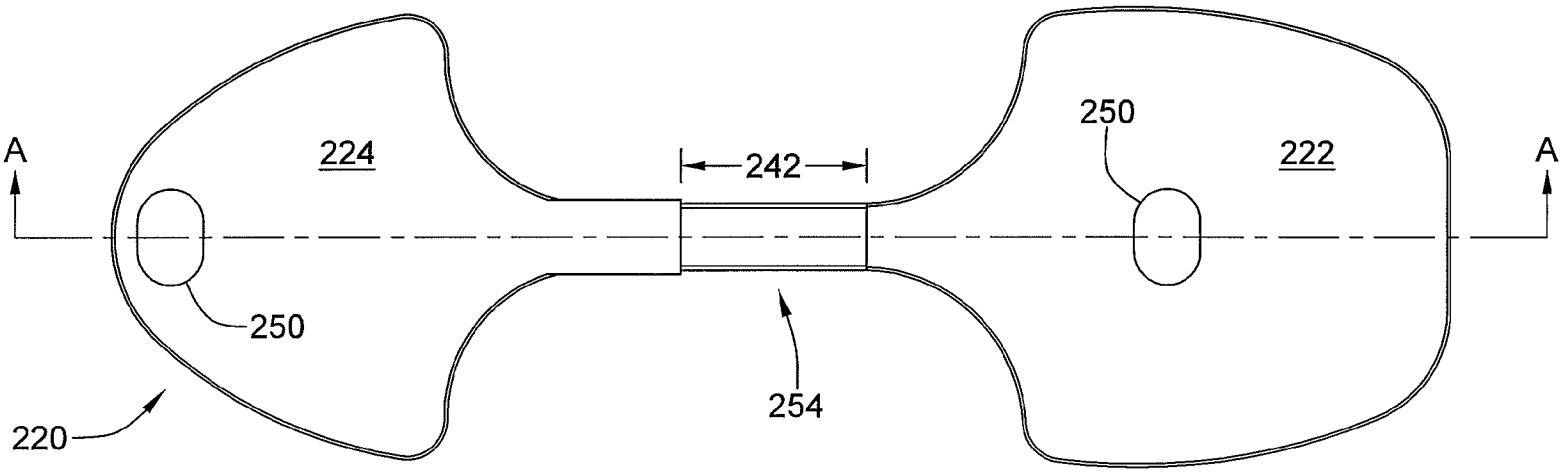
FIG. 33 is a top view of the telescopic caster board of FIG. 31.

Referring now more specifically to FIGS. 32 and 33, skateboard 220 is shown in a collapsed or unextended configuration and an extended configuration in which an extended portion 242 of tongue 244 is visible. Skateboard 220 is symmetrical about long axis 248. Wells 250 provide an opening through the upper surface of the board to the interior of hollow triangular mounting 230 which may be used to secure caster wheel assembly 226 to the board by for example tightening a nut (not shown) along pivot axis 228. Triangular mounting 230 is used to offset pivot access 228 from the vertical.

Front section 224 includes front foot support area 252 generally aft of well 250 toward narrower center section 254 so that a user's foot is generally supported over caster wheel 234 in front section 224. Similarly, rear foot support area 256 supports a user's foot generally over the caster wheel mounted to rear section 222. When skateboard 220 is extended partially, or fully as shown for example in FIG. 33, narrow center section 254 is extended by tongue portion 242.

When ridden, in either a collapsed or extended configuration, board 220 may be twisted about long axis 248 by the application of differential pressure by the user to foot support areas 252 and 256. Front and rear sections 224 and 222 include a riding or upper board 258 having a board thickness 260 as shown in FIG. 30. Board 258 resists twisting along long axis 248 in part in accordance with the width of the board. That is, considering only board 258 for the moment, board 258 would twist more in center section 254 than it would in front or rear sections 224 and 222. However, as noted above, tongue 242 and hollow chamber 240 may preferably be molded as an integral piece with board 258 in front and rear sections 224 and 222 as well as along narrower central sections 254. As a result, the resistance to twisting along long axis 248 is increased by the integral molding of tongue 246 and hollow chamber 240 with board 258 in front and rear sections 224 and 222. As a result, tongue 246 and chamber 240 serve to control the twisting of board 258, and resist bowing of board 258, in generally the same manner as provided by the sidewalls and wells discussed above.

Figure 34:
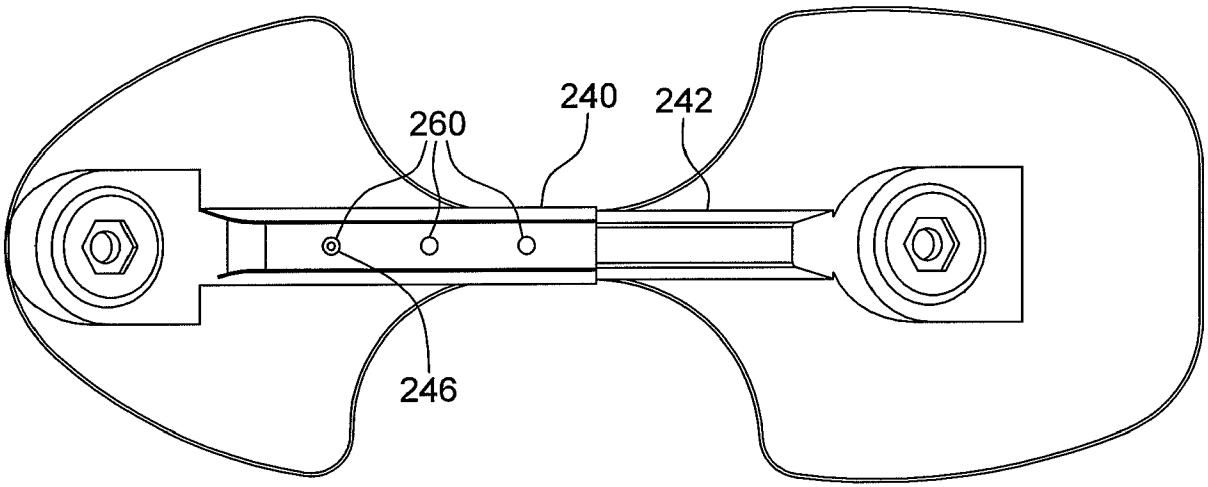
FIG. 34 is a bottom view of the telescopic caster board of FIG. 30.
Figure 35:
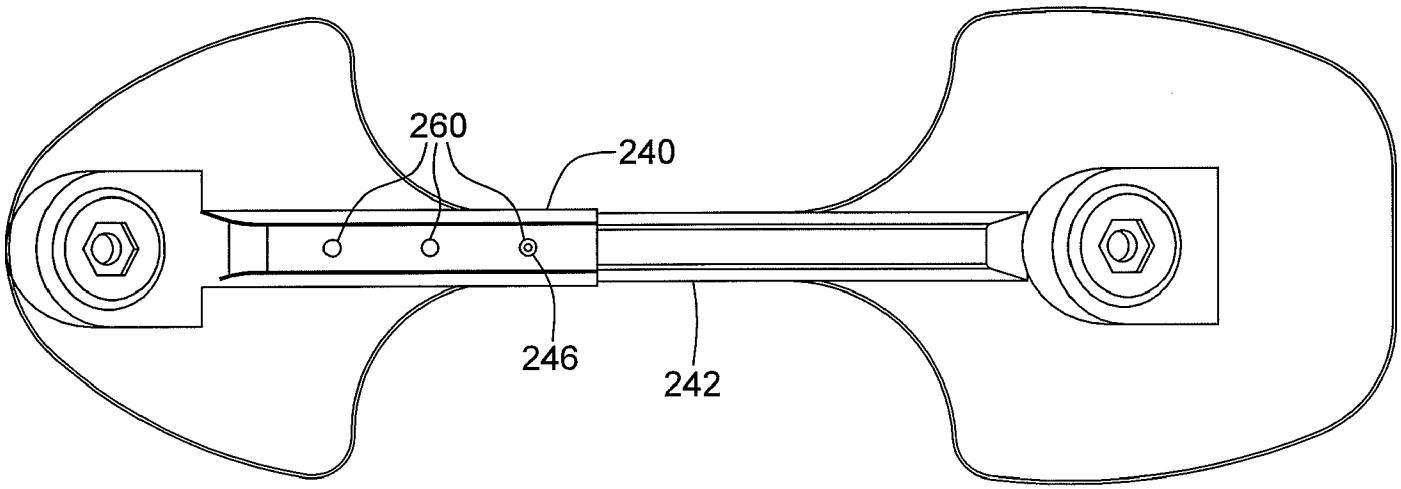
FIG. 35 is a bottom view of the telescopic caster board of FIG. 31.

Further, at least some portion of tongue 244 is fit within chamber 240. The combination of this portion of tongue 246 and chamber 240 serves to resist any relative shifting of the portions of board 258 in front and rear sections 224 and 222 so that skateboard 220 may be smoothly twisted along long axis 248 by differential pressure applied by the user's feet to foot support areas 252 and 256 to cause or add to location of skateboard 220. The amount of extension of skateboard 220, that is, the length of visible portion 242 extended out of hollow chamber 240, may be controlled by extension control 246. Extension control 246 may be a button, protruding through a hole in tongue 242 and engaging with one of several holes 260 in hollow chamber 240. As shown in FIG. 34, extension control 246 may be engaged with the most forward hole 260 when skateboard 220 is fully collapsed as shown in FIG. 34 or with the most rearward hole 260 when skateboard 220 is fully extended as shown in FIG. 35.

Figure 36:
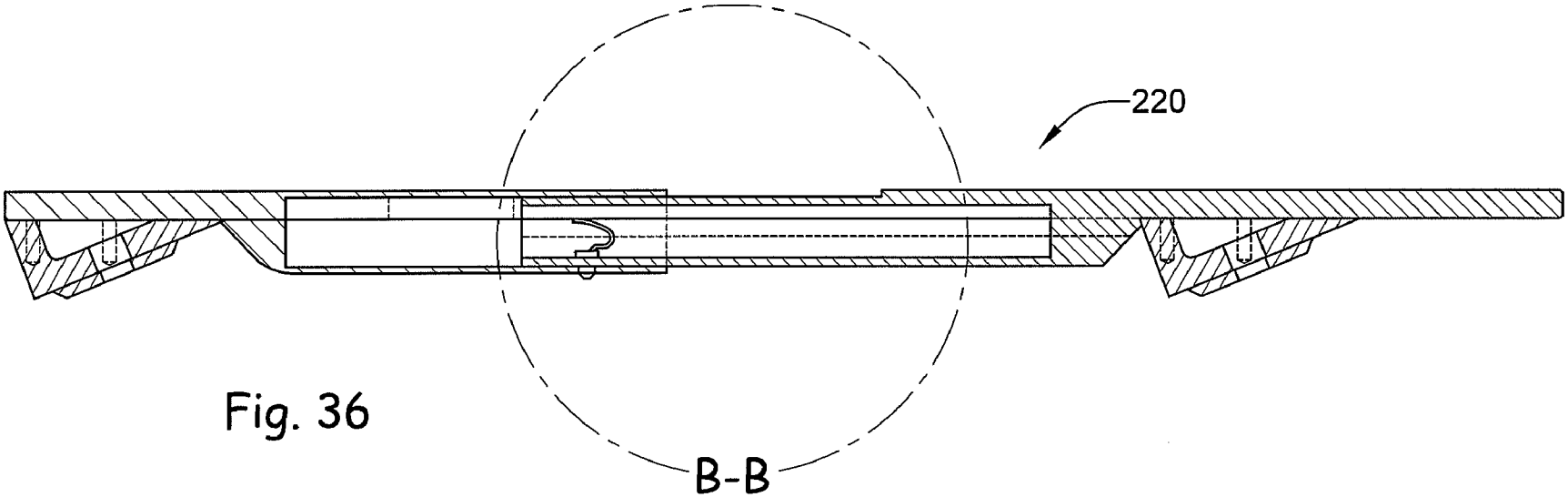
FIG. 36 is a cross sectional view of telescopic caster board 220 of FIG. 33 taken along line AA.
Figure 37:
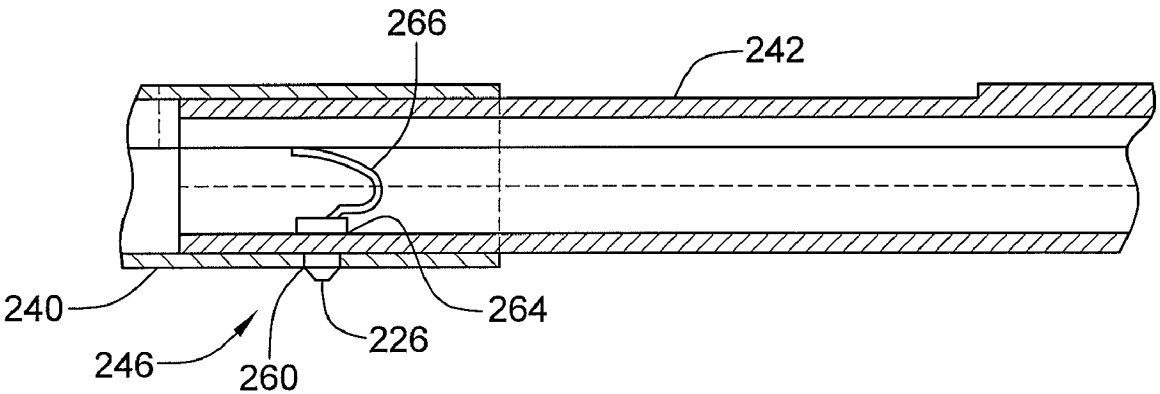
FIG. 37 is an exploded view of a section BB shown in FIG. 36.

Referring now in particular to FIGS. 36 and 37, FIG. 36 is a cross sectional view of skateboard 220, without wheel assemblies 226. FIG. 37 is an exploded view of area BB of FIG. 37 including extension control 246 in which button 262 protrudes through hole 260 in a wall of chamber 240 to lock tongue 242 at a fixed length of extension in chamber 240. Button 246 may extend through hole 264 in tongue 242 and be held in place by spring 266.

Figure 38:
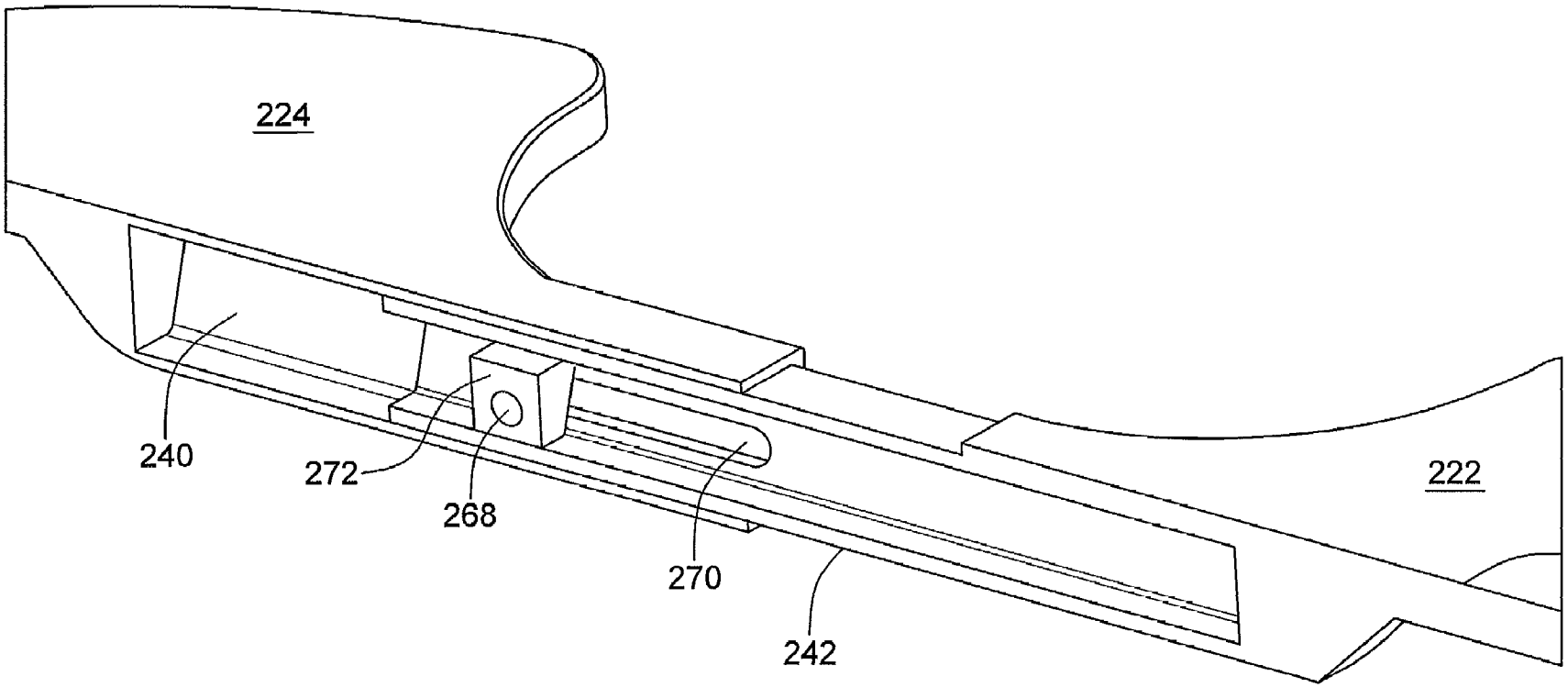
FIG. 38 is a cross section view of telescopic caster board 220 of FIG. 33 taken along line AA which illustrates an alternate embodiment of extension control 246.

Referring now particularly to FIG. 38, a cross section of skateboard 220, taken along line AA in FIG. 33, illustrates a portion of hollow chamber 240 in front section 224 in which tongue 242 is held in place by an alternate embodiment of extension control 246. In particular, bolt 268 extends through a hole in front section 224 (not visible in this view) and slot 270 in tongue 242. Bolt 268 is held in place by tightening against nut 272 to secure tongue 242 at a fixed extension with regard to hollow chamber 240 or in a collapsed position. Extension control 246 in this embodiment may be tightened or loosened by for example knurled knob 274 visible in FIG. 39.

Figure 39:
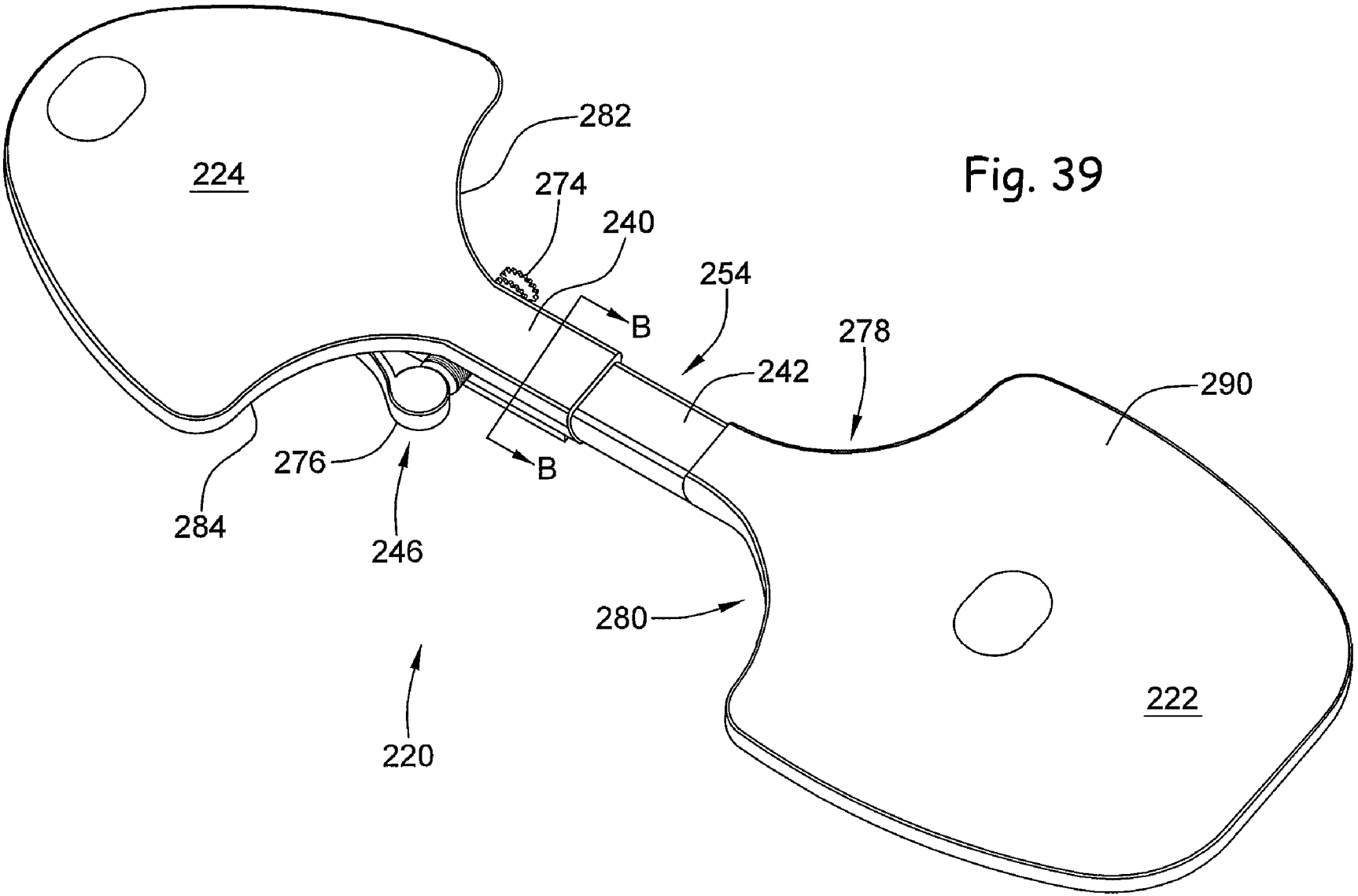
FIG. 39 is an isometric view of telescopic caster board 220 which illustrates a further alternate embodiment of extension control 246.

Referring now particularly to FIG. 39, tongue 242 of rear section 222 may be locked at a fixed extension out of hollow chamber 240 by actuation of a further alternate embodiment of extension control 246 in which knurled knob 274 is one end of a shaft extending through narrow central section, the other end of which supports locking cam lever 276.

Referring now also to FIG. 39, one of the advantages of a telescoping skateboard is that the size of the skateboard can be reduced for portability. That is, the skateboard may be designed so that it can be extended fully for riding and then collapsed for ease of carrying. It may therefore be desirable to have the collapsed skateboard as short and light as possible. In order to make the skateboard as short as possible, the mounting well for the forward caster wheel may be placed as far forward as possible. As shown for example in FIG. 30, the leading edge of mounting well 230 may be positioned at the leading edge of front section 224. Foot support area 256 of rear section 222 should be supported generally above caster 235, so the forward section of caster wheel assembly 226 for the rear section is positioned so that caster wheel 236 is generally below foot support area 256.

Tongue 242 is integrally molded with board 258 in rear section 222 and hollow chamber is integrally molded with board 258 for front section 224. Narrower central section 254 is preferably sufficient rigid and resistant to bowing to support the rider's weight even when the rider's feet are positioned closer to the central section than foot support areas 256, for example, during complex riding maneuvers. To maximize the strength and rigidity of narrow central section 254, tongue 242 and hollow chamber 240 in which tongue 242 is positioned, are made a long as possible.

It may also be desirable to make skateboard 220 as light as possible. As shown in the figures, narrower central section 254 may be made as narrow as the width of chamber 240 because the resistance to twisting and/or bowing along long axis 248 is provided not only by board 258 but also by the walls of hollow chamber 240, the structure of tongue 242 and the interaction between them. The hollow chamber should be as long as possible and may extend from the rear edge of well 230 to the rear edge of front section 224. Similarly, tongue 242 may extend from the forward edge of mounting 230 in rear section 222, past the forward edge of board 258 of section 222 to substantially fill the length hollow chamber 240.

Transitional areas 278, 280, 282 and 284, in narrow central section 254, permit skateboard 220 to be relatively light by reducing the surface areas of front and rear sections 224 and 222. Similarly, construction of the telescopic assembly, formed by tongue 242 and chamber 240, of plastic further reduces the weight of skateboard 220.

Figure 40:
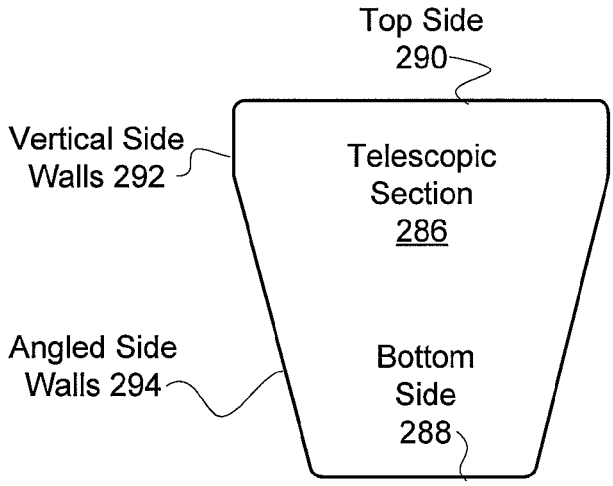
FIG. 40 is a cross sectional view of chamber 240 taken along line BB in FIG. 39.

Referring now to FIG. 40, telescopic section 286 is a cross sectional view of chamber 240 in FIG. 39 taken along line BB. Telescopic section 286 may be a polyhedron shape into which fits a similar, but slightly smaller shape of tongue 242. Top side is parallel with bottom side 288 and riding surface or riding board 290 and preferably forms a portion of upper or riding board 290 of skateboard 220 shown in FIG. 39. Vertical sidewalls 292 serve to resist bowing of riding board 290, for example when a rider does not position his weight directly above the caster wheel assemblies. Vertical side walls 292 may preferably be on the order of board thickness 260 of board 258 shown in FIG. 30. Angled sidewalls 294 also resist bowing of board 258 and extend between vertical side walls 292 and bottom side 288.

Tongue 242 preferably fits sufficiently tightly within telescopic section 286 to cause tongue 242 and chamber 240 to twist together and sufficiently loosely so that extension control 246 can be used to easily permit adjustment of the length of skateboard 220.

Figure 41:
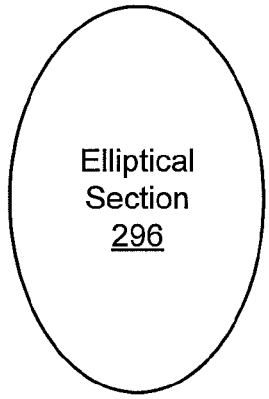
FIG. 41 is an alternate elliptical cross sectional shape.
Figure 42:
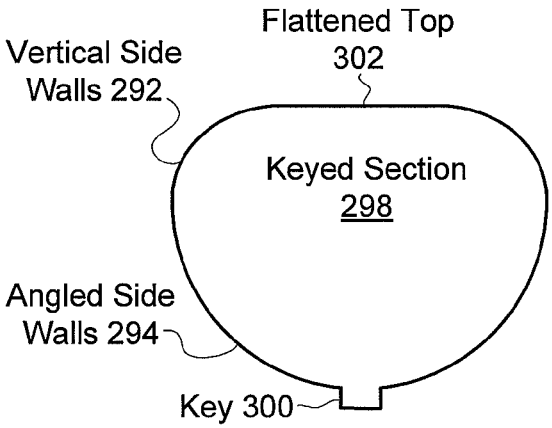
FIG. 42 is an alternate cross keyed sectional shape.
Figure 43:
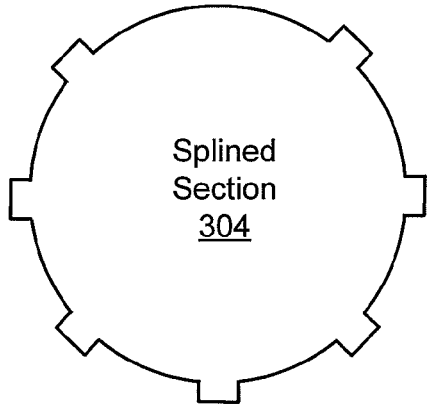
FIG. 43 is an alternate cross splined sectional shape.

Referring now also to FIGS. 41 through 43, other sectional shapes can be used for the telescopic sections. FIG. 41 illustrates elliptical section 296 which may provide increased resistance to bending while reducing relative twisting between tongue 242 and chamber 40. FIG. 42 illustrates keyed section 298 which may be a modified circular section including a key portion 300 to resist relative twisting. Keyed section 298 may also include flatted top side 302 to reduce the distance that the section extends below riding board 290 while further reducing any tendency for relative twist between the telescoping sections. Keyed section 298 may also be considered to include generally vertical side walls 292 and angled side walls 294. FIG. 43 illustrates splined section 304 in which multiple keys are used to further reduce any tendency for tongue 242 to twist or rotate within chamber 240.

We claim:

1. A telescopic flexible skateboard, comprising:

a front section including an integral board portion with a foot support area and supporting a first offset caster wheel assembly pivotable about a first axis at a first angle to the vertical;

a rear section including an integral board with a foot support area and supporting a second offset caster wheel assembly pivotable about a second axis;

telescopic male and female portions, each connected to one of the front or rear sections, slidably engaged to form a telescopic skateboard having a long axis with a narrowed central section; and an extension control operable by a skateboard rider to lock the slidably engaged male and female portions, wherein the front and rear sections, including the male and female portions, are sufficiently flexible so that a user can provide locomotion to the skateboard by applying differential pressure to the front and rear sections.

2. The invention of claim 1, wherein the telescopic skateboard is sufficiently resistant to twisting along the central axis to permit a rider to comfortably steer the skateboard by tilting the skateboard platform without substantially rotating the front and rear sections relative to each other while being sufficiently flexible to be twisted across the narrowed central section in alternating directions about the long axis by the rider to provide locomotion of the skateboard by the rider by rotating the front and rear sections relative to each other.

3. The invention of claim 1 wherein the telescopic skateboard is sufficiently flexible to be twisted in alternating directions about the long axis by the rider to provide locomotion from a standing start.

4. The invention of claim 1 wherein the telescopic skateboard platform is sufficiently resistant to bowing in the narrowed central section area to support the rider without substantial bowing along the long axis when the rider at least partially supports one foot on the narrowed central section.

5. The invention of claim 1 wherein the telescopic male and female portions each further comprises:

a pair of mating downward facing walls at least extending below the narrowed central section to resist resisting bowing along the long axis.

6. The invention of claim 5 wherein the telescopic male and female portions each further comprise:

a molded plastic riding board including hollow wedges molded therein for mounting the wheels at the common acute angle.

7. The invention of claim 6 wherein the telescopic male and female portions each further comprise:

a molded plastic riding board including one of the telescopic male and female portions molded together with the molded plastic board.

8. The invention of claim 5 wherein the telescopic male and female portions each further comprise:

a molded plastic riding board including one of the telescopic male and female portions molded together with the molded plastic board.

9. The invention of claim 5 wherein the telescopic male and female portions each further comprise:

a molded portion having a pair of substantially vertical walls.

10. The invention of claim 9 wherein a vertical dimension of the substantially vertical walls is on the order of a vertical thickness of the riding board.

11. The invention of claim 9 wherein the molded portion further comprises:

a pair of substantially angled side walls each connection to one of the substantially vertical walls.

12. The invention of claim 5 wherein the telescopic male and female portions each further comprise:

a relatively flat top side in a plane parallel with the riding board.

13. The invention of claim 5 wherein the telescopic male portion has a four sided cross section.

14. The invention of claim 5 wherein the telescopic male portion has an elliptical cross section.

15. The invention of claim 5 wherein the telescopic male portion has a cross section including one or more keys to reduce relative twist between the male and female portions.

* * * * *